US012421950B2

(12) United States Patent
Kay et al.

(10) Patent No.: US 12,421,950 B2
(45) Date of Patent: Sep. 23, 2025

(54) VARIABLE DIAMETER VALVE BORES FOR THRU ROD FLUID ENDS

(71) Applicant: GD Energy Products, LLC, Tulsa, OK (US)

(72) Inventors: Konner Casey Kay, Broken Arrow, OK (US); Adam Bradley Avey, Tulsa, OK (US); Christopher Calvin Call, Broken Arrow, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/517,054

(22) Filed: Nov. 22, 2023

(65) Prior Publication Data

US 2025/0163902 A1 May 22, 2025

(51) Int. Cl.

| | |
|---|---|
| ***F04B 39/10*** | (2006.01) |
| ***F04B 43/06*** | (2006.01) |
| ***F04B 49/12*** | (2006.01) |
| ***F04B 49/18*** | (2006.01) |
| ***F04B 53/10*** | (2006.01) |

(52) U.S. Cl.

CPC ..... *F04B 39/1046* (2013.01); *F04B 49/12* (2013.01); *F04B 49/18* (2013.01); *F04B 43/06* (2013.01); *F04B 53/1087* (2013.01)

(58) Field of Classification Search

CPC ..... F04B 39/1046; F04B 49/12; F04B 49/18; F04B 43/06; F04B 53/1087; F04B 53/10; F04B 39/10; F04B 39/1066; F04B 39/12; F04B 39/121; F04B 39/122; F04B 39/123

See application file for complete search history.

(56) References Cited

U.S. PATENT DOCUMENTS

| | | | | |
|---|---|---|---|---|
| 5,059,101 | A | 10/1991 | Valavaara | |
| 10,100,852 | B2 | 10/2018 | Morreale et al. | |
| 10,655,623 | B2 | 5/2020 | Blume | |
| 2013/0195701 | A1* | 8/2013 | Skurdalsvold | F04B 53/007 417/521 |
| 2020/0291928 | A1* | 9/2020 | Mullins | F04B 23/06 |

FOREIGN PATENT DOCUMENTS

| | | | |
|---|---|---|---|
| CA | 2021524 | A1 | 1/1992 |
| CN | 218624615 | U | 3/2023 |

* cited by examiner

*Primary Examiner* — Bryan M Lettman
(74) *Attorney, Agent, or Firm* — Edell, Shapiro & Finnan, LLC

(57) ABSTRACT

A relationship between tie rods and a valve seat bore in a fluid end. The profile of the valve seat bores are changed to allow the tie rods to pass through the fluid end without intersecting or intercepting the internal bore geometry, while still being compatible with industry standard internal components. A relationship between a plunger bore diameter and a flow area of a valve seat in a fluid end is used to identify acceptable fluid end casing designs that can be used with industry standard couplers, such as tie rods.

20 Claims, 17 Drawing Sheets

VARIABLE DIAMETER VALVE BORES FOR THRU ROD FLUID ENDS

FIELD OF INVENTION

The present invention relates to the field of high pressure reciprocating pumps and, in particular, to coupling a fluid end of a high pressure reciprocating pump to a power end of the high pressure reciprocating pump.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end includes a crankshaft that drives a plurality of reciprocating plungers or pistons near or within the fluid end to pump fluid at high pressure.

Conventional fluid ends that utilize an industry standard tie rod pattern require a fluid end with a flange machined into its back end to catch the tie rods. This flange is required because the tie rod spacing is close enough that the tie rods would intersect the valve seat bores if they passed through the entire fluid end. Machining this flange requires a significant amount of machining and raw material to create.

SUMMARY

The present application relates to a fluid end casing of a fluid end for a reciprocating pump and the relationship between couplers, such as tie rods, and a valve bore formed in the fluid end casing. This relationship allows the use of through rod style tie rods for an industry standard tie rod pattern. As a result, being able to utilize an industry standard tie rod pattern significantly reduces the size and the cost of manufacturing a fluid end.

In one aspect of the present application, a reciprocating pump comprises a power end configured to generate pumping power, a fluid end having a fluid end casing including an inlet bore having a first longitudinal axis, the inlet bore including a first portion having a first inner diameter and a second portion having a second inner diameter, an outlet bore having a second longitudinal axis, the outlet bore including a third portion having a third inner diameter and a fourth portion having a fourth inner diameter, the second longitudinal axis being colinear with the first longitudinal axis, a first hole extending through the fluid end casing, and a second hole extending through the fluid end casing, the second hole extending parallel to the first hole, the second hole is spaced apart from the first hole by a first distance, the first distance being less than the first inner diameter and greater than the second inner diameter, and a plurality of couplers mounting the fluid end to the power end, the plurality of couplers including a first coupler extending through the first hole and a second coupler extending through the second hole, wherein each of the first coupler and the second coupler is connected at one end to the power end and has a fastener secured to its other end to retain the fluid end casing.

In one embodiment, the fluid end includes a first valve component located in the inlet bore and a second valve component located in the outlet bore. In another embodiment, the first coupler and the second coupler are tie rods. In yet another embodiment, the fluid end casing includes a plunger bore located between and in fluid communication with the inlet bore and the outlet bore, the plunger bore having a fifth inner diameter, and a distance between the first hole and the second hole being less than the fifth inner diameter. In another embodiment, the first hole has a third longitudinal axis and has a first radius, the second hole has a fourth longitudinal axis and has a second radius, and a distance between the third longitudinal axis and the fourth longitudinal axis less both the first radius and the second radius is less than the first inner diameter and greater than the second inner diameter In an alternative embodiment, the fluid end casing includes a third hole extending through the fluid end casing, the third hole having a fifth longitudinal axis, and a fourth hole extending through the fluid end casing, the fourth hole having a sixth longitudinal axis, and each of the first hole, the second hole, the third hole, and the fourth hole is parallel to each other. In another embodiment, the third hole and the fourth hole are spaced apart by a second distance, the second distance being less than the third inner diameter and greater than the second inner diameter. In yet another embodiment, the second distance is the same as the first distance. Alternatively, the third hole has a third radius, the fourth hole has a fourth radius, and the distance between the fifth longitudinal axis and the sixth longitudinal axis less both the third radius and the fourth radius is less than the third inner diameter and greater than the fourth inner diameter.

In an alternative embodiment, the first hole has a third longitudinal axis and has a first radius, the second hole has a fourth longitudinal axis and has a second radius, and the fluid end casing includes a third hole extending through the fluid end casing, the third hole having a fifth longitudinal axis and a third radius, and a fourth hole extending through the fluid end casing, the fourth hole having a sixth longitudinal axis and a fourth radius, wherein a distance between the third longitudinal axis and the fourth longitudinal axis less both the first radius and the second radius is less than the first inner diameter and greater than the second inner diameter, and a distance between the fifth longitudinal axis and the sixth longitudinal axis less both the third radius and the fourth radius is less than the third inner diameter and greater than the fourth inner diameter.

In another embodiment, the distance between the third longitudinal axis and the fourth longitudinal axis less both the first radius and the second radius is the same has the distance between the fifth longitudinal axis and the sixth longitudinal axis less both the third radius and the fourth radius.

In another aspect of the present application, a reciprocating pump comprises a power end configured to generate pumping power, a fluid end having a fluid end casing including a first variable diameter bore having a first longitudinal axis, a first portion having a first inner diameter, and a second portion having a second inner diameter, a second variable diameter bore having a second longitudinal axis, a third portion having a third inner diameter, and a fourth portion having a fourth inner diameter, the second longitudinal axis being colinear with the first longitudinal axis, a first pair of through holes extending through the fluid end casing, the first pair of through holes being proximate to the first variable diameter bore, and the first pair of through holes being spaced apart from each other by a first distance, the first distance being less than the first inner diameter and being greater than the second inner diameter, and a second pair of through holes extending through the fluid end casing, the second pair of through holes extending parallel to the first pair of through holes and being proximate to the second variable diameter bore, and the second pair of through holes being spaced apart from each other by a second distance, the second distance being less than the third inner diameter and being greater than the fourth inner diameter, and a plurality of couplers mounting the fluid end to the power end, each one of the plurality of couplers being inserted into one of the first pair of through holes or one of the second pair of through holes, wherein each of the plurality of couplers is connected at one end to the power end and has a fastener secured to its other end to retain the fluid end casing.

In an alternative embodiment, the fluid end includes a first valve component located in the first variable diameter bore and a second valve component located in the second variable diameter bore, and each of the plurality of couplers is a tie rod. In another embodiment, each of the first pair of through holes has a longitudinal axis and a radius, and a distance between the longitudinal axes of the first pair of through holes less the radii of the first pair of through holes is less than the first inner diameter and greater than the second inner diameter. In yet another embodiment, each of the second pair of through holes has a longitudinal axis and a radius, and a distance between the longitudinal axes of the second pair of through holes less the radii of the second pair of through holes is less than the third inner diameter and greater than the fourth inner diameter. Alternatively, the distance between the longitudinal axes of the first pair of through holes less the radii of the first pair of through holes is the same as the distance between the longitudinal axes of the second pair of through holes less the radii of the second pair of through holes.

In another aspect of the present application, a fluid end of a reciprocating pump comprises a fluid end casing including a first variable diameter bore having a first longitudinal axis, a first portion having a first inner diameter, and a second portion having a second inner diameter, a second variable diameter bore having a second longitudinal axis, a third portion having a third inner diameter, and a fourth portion having a fourth inner diameter, the second longitudinal axis being colinear with the first longitudinal axis, a first pair of through holes extending through the fluid end casing, the first pair of through holes being proximate to the first variable diameter bore, and the first pair of through holes being spaced apart from each other by a first distance, the first distance being less than the first inner diameter and being greater than the second inner diameter, and a second pair of through holes extending through the fluid end casing, the second pair of through holes extending parallel to the first pair of through holes and being proximate to the second variable diameter bore, and the second pair of through holes being spaced apart from each other by a second distance, wherein the second distance is less than the third inner diameter and being greater than the fourth inner diameter.

In one embodiment, each of the first pair of through holes has a longitudinal axis and a radius, and a distance between the longitudinal axes of the first pair of through holes less the radii of the first pair of through holes is less than the first inner diameter and greater than the second inner diameter. In another embodiment, each of the second pair of through holes has a longitudinal axis and a radius, and a distance between the longitudinal axes of the second pair of through holes less the radii of the second pair of through holes is less than the third inner diameter and greater than the fourth inner diameter. In yet another embodiment, the distance between the longitudinal axes of the first pair of through holes less the radii of the first pair of through holes is the same as the distance between the longitudinal axes of the second pair of through holes less the radii of the second pair of through holes.

In another aspect of the invention, a reciprocating pump comprises a power end configured to generate pumping power, a fluid end having a fluid end casing including an inlet bore having a valve seat located therein, the valve seat having a first inner surface and a flow area defined by a plane extending across the valve seat, a plunger bore having a second inner surface defining a plunger bore inner diameter, a first hole extending through the fluid end casing, the first hole having a first longitudinal axis, and a second hole extending through the fluid end casing, the second hole having a second longitudinal axis, the second hole extending parallel to the first hole, the second longitudinal axis is spaced apart from the first longitudinal axis by a first distance, and a plurality of couplers mounting the fluid end to the power end, the plurality of couplers including a first coupler extending through the first hole and a second coupler extending through the second hole, each of the first coupler and the second coupler is connected at one end to the power end and has a fastener secured to its other end to retain the fluid end casing, wherein the plunger bore inner diameter divided by the flow area is a first ratio, the first ratio multiplied by the first distance is a second ratio, and the second ratio is less than 22.

In one embodiment, the first inner surface defines a valve seat inner diameter, and the valve seat inner diameter is in a range from 2 inches to 6 inches.

In another embodiment, the first distance is about 6.25 inches.

In another embodiment, the plunger bore inner diameter is in the range from 2 inches to 8 inches, and the second ratio is less than 16.

In another embodiment, the plunger bore inner diameter is in the range from 2 inches to 8 inches, and the second ratio is in a range from 0.44 to 15.92.

In another embodiment, the plunger bore inner diameter is in the range from 4 inches to 5 inches, and the second ratio is in a range from 0.88 to 9.95.

In one embodiment, the first distance is about 8.25 inches.

In another embodiment, the plunger bore inner diameter is in the range from 2 inches to 8 inches, and the second ratio is less than 22.

In another embodiment, the plunger bore inner diameter is in the range from 2 inches to 8 inches, and the second ratio is in a range from 0.58 to 21.01.

In yet another embodiment, the plunger bore inner diameter is in the range from 4 inches to 5 inches, and the second ratio is in a range from 1.17 to 13.13.

In an alternative aspect of the invention, a reciprocating pump comprises a power end configured to generate pumping power, a fluid end having a fluid end casing including an inlet bore having a valve seat located therein, the valve seat defining a valve seat inner diameter, the valve seat inner diameter is in a range from 2 inches to 6 inches, and the valve seat defines a cross-sectional flow area extending across the valve seat, a plunger bore defining a plunger bore inner diameter, the plunger bore inner diameter is in a range from 2 inches to 8 inches, a first hole extending through the fluid end casing and having a first longitudinal axis, and a second hole extending through the fluid end casing and having a second longitudinal axis, the second longitudinal axis is parallel to and spaced apart from the first longitudinal axis by a first distance, the first distance is about 6.25 inches, a first tie rod extending through the first hole, the first tie rod is connected to the power end and to the fluid end, and a second tie rod extending through the second hole, the second tie rod is connected to the power end and to the fluid end, wherein the plunger bore inner diameter divided by the cross-sectional flow area is a first ratio, the first ratio multiplied by the first distance is a second ratio, and the second ratio is less than 16.

In another embodiment, the second ratio is in a range from 0.44 to 15.92.

In another embodiment, the plunger bore inner diameter is in a range from 4 inches to 5 inches, and the second ratio is in a range from 0.88 to 9.95.

In another embodiment, the plunger bore inner diameter is in a range from 2 inches to 4 inches, and the second ratio is in a range from 0.44 to 7.96.

In another embodiment, the plunger bore inner diameter is in a range from 5 inches to 8 inches, and the second ratio is in a range from 1.11 to 15.92.

In another alternative aspect of the invention, a reciprocating pump comprise a power end configured to generate pumping power, a fluid end having a fluid end casing including an inlet bore having a valve seat located therein, the valve seat defining a valve seat inner diameter, the valve seat inner diameter is in a range from 2 inches to 6 inches, and the valve seat defines a cross-sectional flow area extending across the valve seat, a plunger bore defining a plunger bore inner diameter, the plunger bore inner diameter is in a range from 2 inches to 8 inches, a first hole extending through the fluid end casing and having a first longitudinal axis, and a second hole extending through the fluid end casing and having a second longitudinal axis, the second longitudinal axis is parallel to and spaced apart from the first longitudinal axis by a first distance, the first distance is about 8.25 inches, a first tie rod extending through the first hole, the first tie rod is connected to the power end and to the fluid end, and a second tie rod extending through the second hole, the second tie rod is connected to the power end and to the fluid end, wherein the plunger bore inner diameter divided by the cross-sectional flow area is a first ratio, the first ratio multiplied by the first distance is a second ratio, and the second ratio is less than 22.

In one embodiment, the second ratio is in a range from 0.58 to 21.01.

In another embodiment, the plunger bore inner diameter is in a range from 4 inches to 5 inches, and the second ratio is in a range from 1.17 to 13.13.

In another embodiment, the plunger bore inner diameter is in a range from 2 inches to 4 inches, and the second ratio is in a range from 0.58 to 10.50.

In yet another embodiment, the plunger bore inner diameter is in a range from 5 inches to 8 inches, and the second ratio is in a range from 1.46 to 21.01.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a relationship between the tie rods and a valve bore in a fluid end. In an aspect of this application, the profile of the valve seat bores are changed to allow the tie rods to pass through the fluid end without intersecting or intercepting the internal bore geometry, while still being compatible with industry standard internal components. The solution disclosed herein eliminates the need for an adapter plate of any kind, while still utilizing existing tie rod locations in a fluid end. As a result, raw material and labor costs associated with mounting an adapter plate on the power end or on the fluid end are eliminated. In addition, the overall size of the forging and associated machining to form a fluid end without the adapter plate is reduced by approximately ⅓ of the size.

The present application relates to fluid end casing bores that support valve seats. Couplers, such as tie rods, are configured for linking the fluid end to a power end of a reciprocating pump. Each coupler is configured to separately pass through the entirety of the fluid end assembly. The couplers are bolted or secured to the front of the fluid end assembly.

In one implementation, a suction valve bore and a discharge valve bore are located within the fluid end assembly, and are configured not to intersect with the fastener bores. A diameter of the valve assembly is greater than a distance between the fastener bores. A diameter of the valve bore section, which is coupled to the plunger bore, is less than the distance between the fastener bores.

Generally, the present application is also directed to a relationship in a fluid end casing between a spacing between a pair of tie rods, a diameter of a plunger bore, and a flow area of a valve seat. In an aspect of this application, the flow area of a valve seat is calculated based on an inner diameter of the valve seat as defined by an inner surface of the valve seat. The spacing between a pair of tie rods is a standard distance throughout the industry.

In different implementations, the diameter of a plunger bore can vary in different fluid end casings. The present application relates to a range of plunger bore diameters from 4 inches to 5 inches. For particular plunger bore diameters, the inner diameter of the valve seat can vary as well. In different embodiments, the plunger bore diameter can be one of 4 inches, 4.5 inches, 4.75 inches, or 5 inches. For each of those plunger bore diameters, the inner diameter of the valve seat is in the range from 2 inches to 6 inches, and can be any of each 0.25 inches therebetween.

Figure 1:
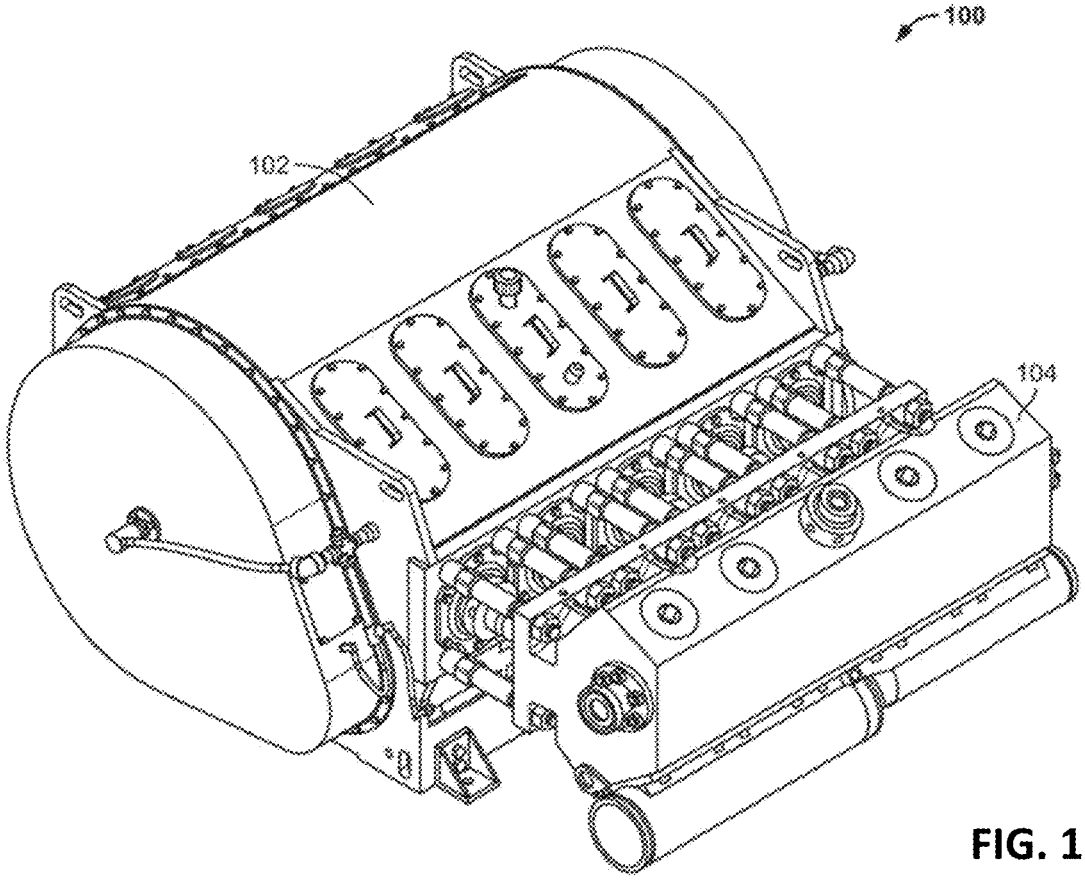
FIG. 1 (PRIOR ART)
FIG. 1 is a front perspective view of a prior art reciprocating pump including a fluid end and a power end.

Referring to FIG. 1, a prior art reciprocating pump 100 is illustrated. The reciprocating pump 100 includes a power end 102 and a fluid end 104. The power end 102 includes a crankshaft 10 (see FIG. 2) that drives a plurality of reciprocating plungers or pistons (generally referred to as "reciprocating elements") within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations. At the same time, the present invention may also offer some specific advantages for hydraulic fracturing, which may be noted herein where applicable.

In any case, often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time needed to complete maintenance operations (minimizing downtime) are highly desirable.

Figure 2:
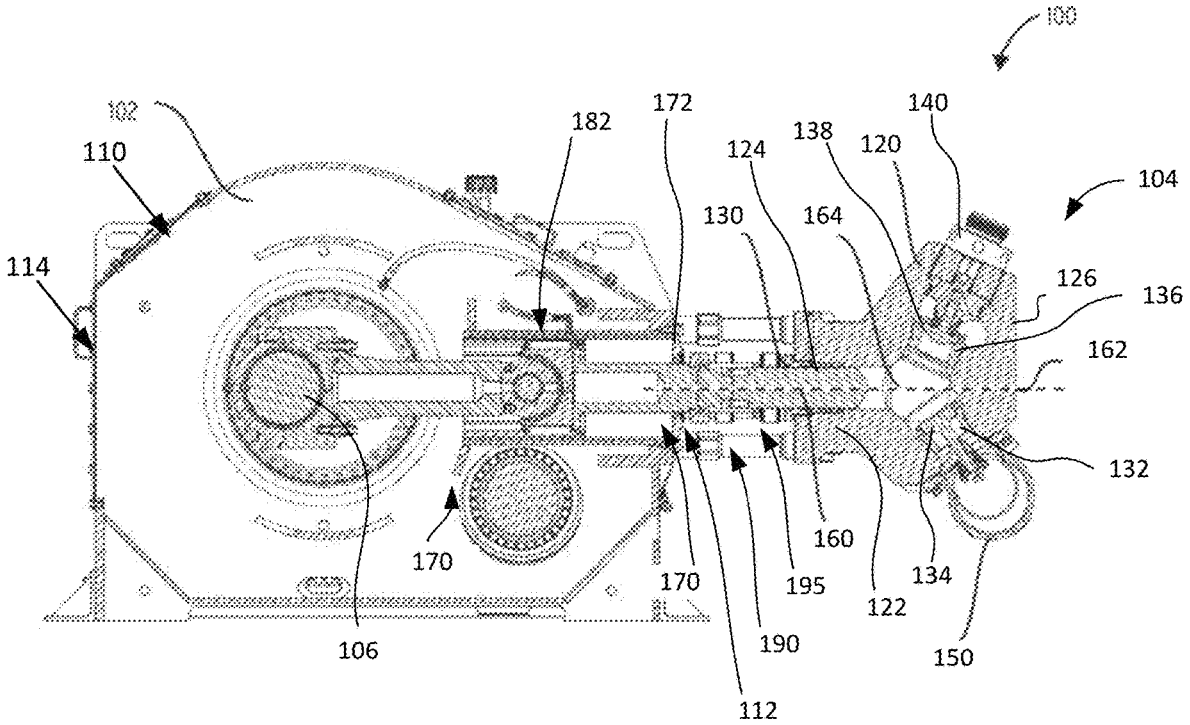
FIG. 2 (PRIOR ART)
FIG. 2 is a side cross-sectional view of the prior art reciprocating pump of FIG. 1.

Still referring to FIG. 1, but now in combination with FIG. 2, the reciprocating pump 100 pumps fluid into and out of pumping chambers 164. FIG. 2 shows a side, cross-sectional view of reciprocating pump 100 taken along a central axis 162 of one of the reciprocating elements 160 included in reciprocating pump 100. Thus, FIG. 2 illustrates a single pumping chamber 164. However, it should be understood that a fluid end 104 can include multiple pumping chambers 164 arranged side-by-side. In fact, in at least some embodiments (e.g., the embodiment of FIG. 1), a casing 120 of the fluid end 104 forms a plurality of pumping chambers 164 and each chamber 164 includes a reciprocating element 160 that reciprocates within the casing 120. However, side-by-side pumping chambers 164 need not be defined by a single casing 120. For example, in some embodiments, the fluid end 104 may be modular and different casing segments may house one or more pumping chambers 164. In any case, the one or more pumping chambers 164 are arranged side-by-side so that corresponding conduits are positioned adjacent each other and generate substantially parallel pumping action. Specifically, with each stroke of the reciprocating element 160, low pressure fluid is drawn into the pumping chamber 164 and high pressure fluid is discharged. But, often, the fluid within the pumping chamber 164 contains abrasive material (i.e., "debris") that can damage seals formed in the reciprocating pump 100, such as the "packing seals" surrounding a reciprocating element 160 of a fracking fluid end, creating a need for continued maintenance.

In various embodiments, the fluid end 104 may be shaped differently and/or have different features, but may still generally perform the same functions, define similar structures, and house similar components. For example, while fluid end 104 includes a first bore 130 that intersects an inlet bore 132 and an outlet bore 136 at skewed angles, other fluid ends may include any number of bores arranged along any desired angle or angles, for example, to intersect bore 130 (and/or an access bore) substantially orthogonally and/or so that two or more bores are substantially coaxial. Generally, bores 132 and 136, as well as any other bores (i.e., segments, conduits, etc.), may intersect to form a pumping chamber 164, may be cylindrical or non-cylindrical, and may define openings at an external surface 126 of the casing 120. Additionally, bores 132 and 136, as well as any other bores (i.e., segments, conduits, etc.), may receive various components or structures, such as sealing assemblies or components thereof.

In the depicted embodiment, inlet bore 132 defines a fluid path through the fluid end 104 that connects the pumping chamber to a piping system 150 delivering fluid to the fluid end 104. Meanwhile, outlet bore 136 allows compressed fluid to exit the fluid end 104. Thus, in operation, bores 132 and 136 may include valve components 134 and 138, respectively, (e.g., one-way valves) that allow bores 132 and 136 to selectively open and deliver a fluid through the fluid end 104. Typically, valve components 134 in the inlet bore 132 may be secured therein by a piping system 106. Meanwhile, valve components 138 in outlet bore 136 may be secured therein by a closure assembly 140 that, in the prior art example illustrated in FIG. 2, is removably coupled to the fluid end 104 via threads.

In operation, fluid may enter fluid end 104 via outer openings of inlet bores 132 and exit fluid end 104 via outer openings of outlet bores 136. More specifically, fluid may enter inlet bores 132 via pipes of piping system 106, flow through pumping chamber 164 (due to reciprocation of a reciprocating elements 160), and then flow through outlet bores 136 into a channel. However, piping system 106 and channel are merely example conduits and, in various embodiments, fluid end 104 may receive and discharge fluid via any number of pipes and/or conduits, along pathways of any desirable size or shape.

Meanwhile, each of bores 130 defines, at least in part, a cylinder for reciprocating elements 160, and/or connects the casing 120 to a cylinder for reciprocating elements 160. More specifically, in the illustrated embodiment, a casing segment 122 houses a packing assembly 124 configured to seal against a reciprocating element 160 disposed interiorly of the packing assembly 124. Reciprocation of a reciprocating element 160 in or adjacent to bore 130, which may be referred to as a reciprocation bore (or, for fracking applications, a plunger bore), draws fluid into the pumping chamber 164 via inlet bore 132 and pumps the fluid out of the pumping chamber 164 via outlet bore 136. However, over time, the packing assembly 124 will wear and/or fail, and thus, must be accessed for maintenance and/or replacement. Other components, such as valve components 134 and/or 138, or the fluid end casing 120 itself may also wear and/or fail and require repair or replacement over time. To help provide access to these parts and/or the pumping chamber, some fluid ends have access bores that are often aligned with (and sometimes coaxial with) the reciprocating bore 130. Other fluid ends needs not include access bore and, thus, such an access bore is not illustrated in FIGS. 1 and 2.

Regardless of whether the fluid end includes an access bore, the packing assembly 124 typically needs to be replaced from an outer opening of bore 130 (i.e., a side of bore 130 aligned with the external surface 126 of the casing 120). At the same time, to operate properly, the fluid end 104 must be securely and stably coupled to the power end 102. Thus, often, with prior art reciprocating pumps like reciprocating pump 100, the fluid end 104 is directly coupled to the power end 102 with relatively short couplers 190 and at least a portion of the reciprocating pump 100 must be disassembled to access bore 130, e.g., to replace packing assembly 124.

Figure 3:
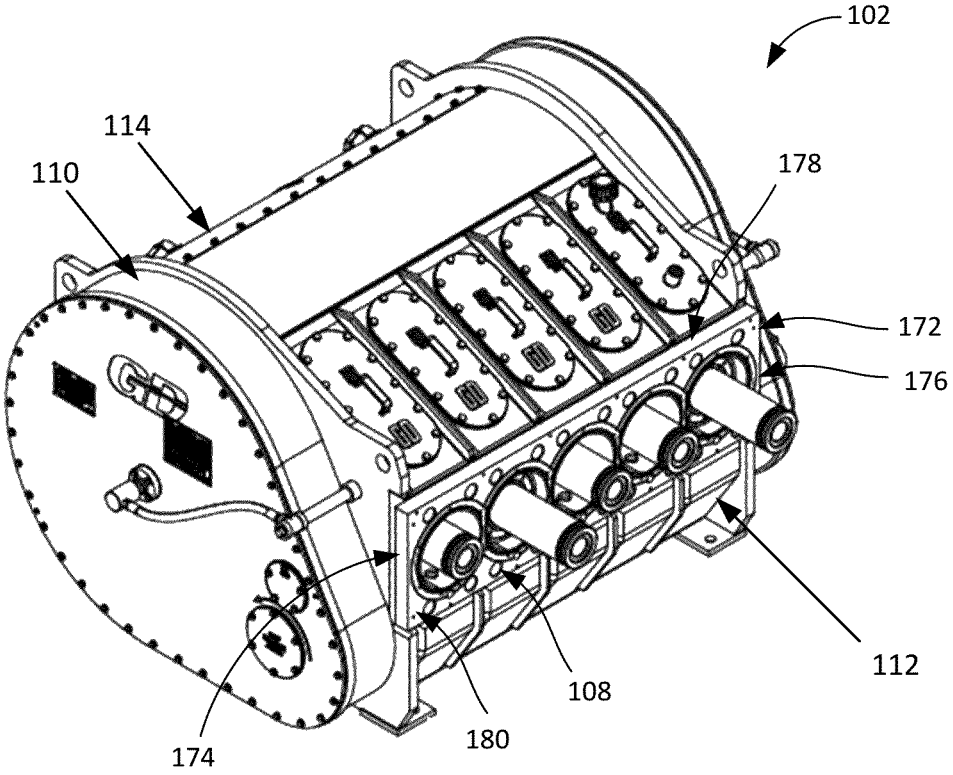
FIG. 3 (PRIOR ART)
FIG. 3 is a front perspective view of the power end of the prior art reciprocating pump of FIG. 1.

Now turning to FIGS. 2 and 3, in the illustrated prior art reciprocating pump 100, couplers 190 (e.g., tie rods, which are sometimes referred to as stay rods) are threaded to a nose plate 172 of a crosshead assembly 170 of the power end 102 to position the fluid end 104 in close proximity to the power end 102. This limits the overall size of the cradle 195 (i.e., the space between the fluid end 104 and the power end 102, in which a plunger or piston may reciprocate), while also limiting the amount of open space available in the cradle 195. Thus, the power end 102 might need to be fully disconnected from the fluid end 104 to create the space needed to service the fluid end 104. But, at the same time, repeatedly connecting and disconnecting the threaded couplers 190 and the nose plate 172 (or from threaded couplers formed on any other fixed or irremovably portion of a power end) may strip the couplers 190 and require replacement of couplers 190.

Moreover, since couplers 190 connect directly to the nose plate 172, the power end 102 may only be able to operate with fluid ends specifically designed to receive couplers 190 in the arrangement dictated by nose plate 172. In the prior art power end 102, this nose plate is welded or otherwise irremovably coupled to a crosshead frame 182 of a crosshead assembly 170 of the power end 102. That is, the nose plate 172 is integrated into or formed with the power end 102. Thus, the power end 102 may only be operable with fluid ends that include coupling features that match the orientation of coupling features included on nose plate 172. At the same time, the position of the nose plate 172 is not adjustable or manipulable because the irremovable connection/integration of the nose plate 172 into the power end 102 allows the nose plate 172 to withstand extremely high stresses imparted thereto during generation of pumping power by the power end 102. That said, in other prior art power ends, couplers 190 might connect directly into another part of portion of a power end that is able to withstand these high stresses (e.g., into a frame portion), but these coupling points are typically fixed on and/or irremovable from the power end 102. Either way, a power end 102 that directly receives couplers connecting the power end 102 to a fluid end 104 may have limited compatibility across different fluid ends.

More specifically, with the prior art power end 102, the locations at which a fluid end 104 may be coupled to the power end 102 are fixed and/or preset by a set of receptacles 108. In this particular prior art power end 102, the nose plate 172 defines the locations of receptacles 108 for the power end 102 (which is positioned at and/or generally defines a front of the power end 102). However, in other embodiments, receptacles 108 could be included in any part or portion of a power end. That is, the power end 102 may include a frame 110 that extends from a front 112 to a back 114 and the receptacles 108 may generally be included in the front 112 of frame 110. Receptacles 108 can be seen in FIG. 3, which shows the power end 102 disconnected from the fluid end 104, e.g., during maintenance of the packing assembly 124 included in the fluid end 104. FIG. 3 also shows how, in this particular embodiment, the nose plate 172 extends from a first end 174 to a second end 176 and also extends from a back surface 178 to a front surface 180.

Figure 4:
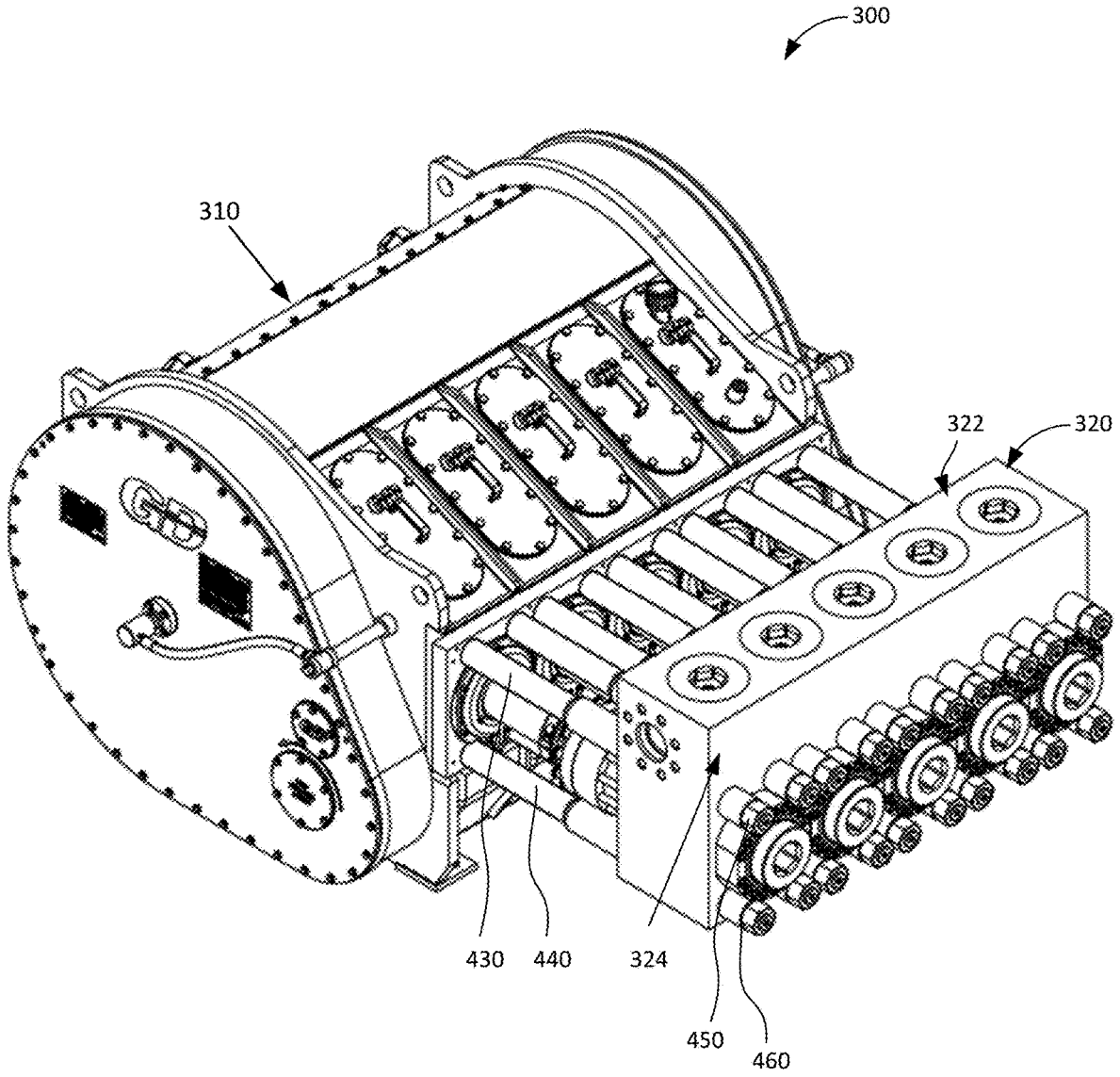
FIG. 4 is a front perspective view of a reciprocating pump including a fluid end coupled to a power end, according to an example embodiment of the present application.

Now turning to FIG. 4, a perspective view of a reciprocating pump 300 with a fluid end 320 coupled to a power end 310 according to an aspect of this application is illustrated. Notably, in this embodiment, as well as other embodiments of the present application, the power end 310 is one example power end that may be used. That said, it should be also understood that the techniques presented herein may be embodied as a new power end.

The fluid end 320 includes a fluid end casing 322 that is coupled to the power end 310. Several couplers, only couplers 430 and 440 are labeled in FIG. 4, are used to mount the fluid end 320 to the power end 310. The couplers 430 and 440 can be stay rods or tie rods, and are described in greater detail below. The fluid end casing 322 has an external surface 324 and several holes or through holes that extend through the fluid end casing 322. The couplers 430 and 440 can be inserted into the through holes and extend outwardly beyond the external surface 324. In this embodiment, fasteners 450 and 460, such as nuts, are secured to the outer ends of the couplers 430 and 440, respectively, to secure the fluid end 320 to the power end 310.

Figure 5:
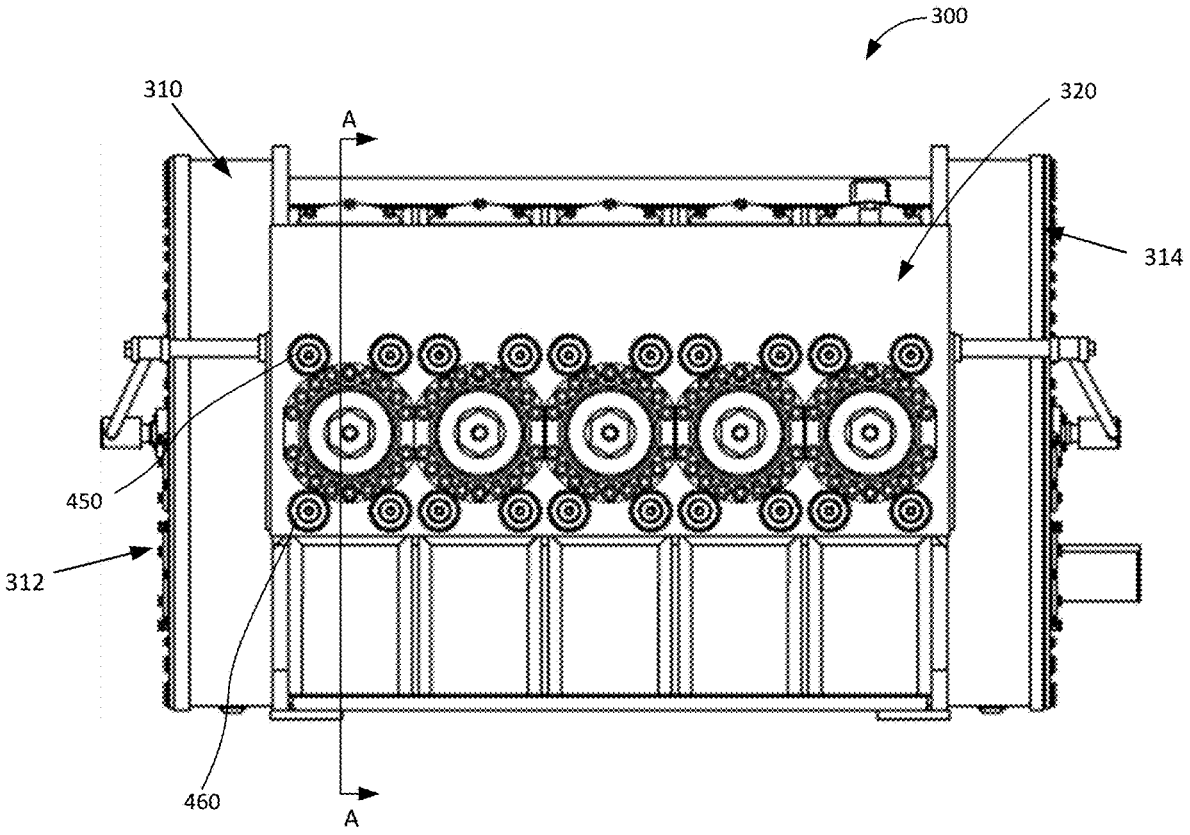
FIG. 5 is a front view of the reciprocating pump illustrated in FIG. 4.

Referring to FIG. 5, a front view of the reciprocating pump 300 is illustrated. The power end 310 has opposite sides 312 and 314, and the positioning of the fluid end 320 relative to the power end 310 is shown.

Figure 6:
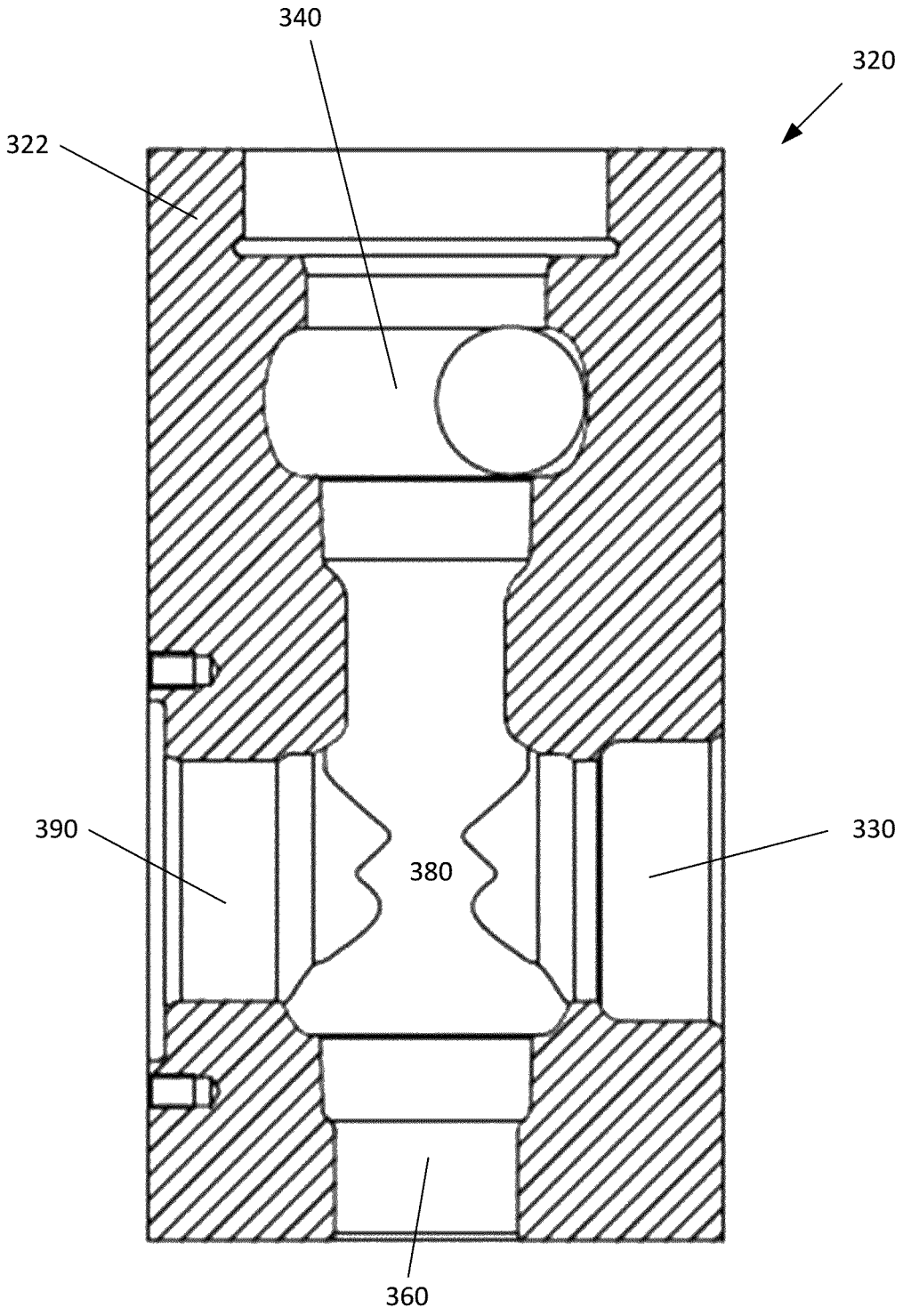
FIG. 6 is a side cross-sectional view of the fluid end of the reciprocating pump illustrated in FIG. 5.

Turning to FIG. 6, a cross-sectional side view of the fluid end casing 322 of the fluid end 320 is illustrated. The fluid end casing 322 includes several bores formed therein. In this embodiment, bore 340 is a discharge bore that has a variable inner diameter. Aligned with bore 340 is a bore 360, which in this embodiment, is a suction bore that has a variable inner diameter as well. The fluid end casing 322 also includes an access bore 330 and a plunger bore 390. Each of the bores 330, 340, 360, and 390 intersect at a center or cross bore 380.

Figure 7:
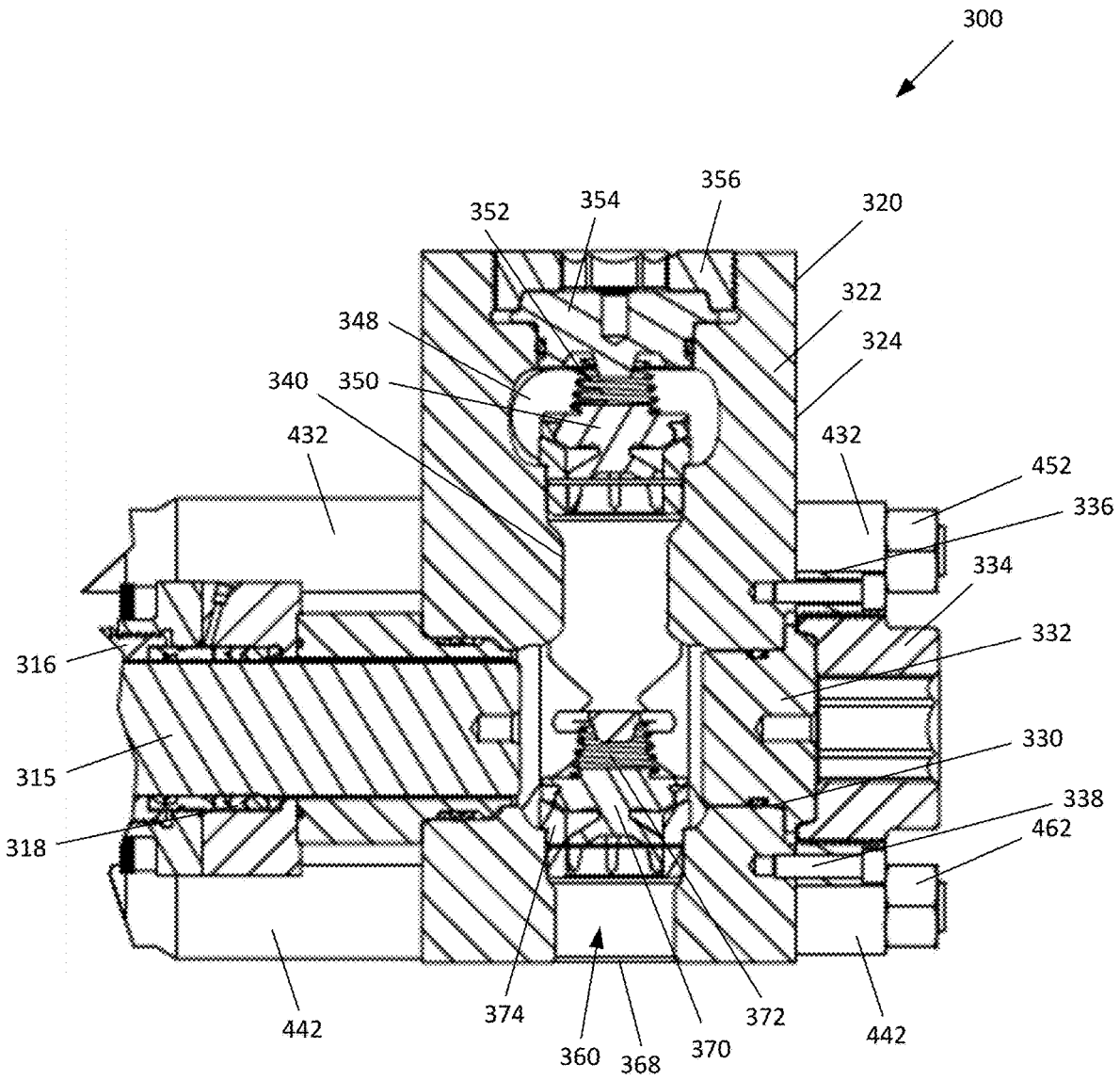
FIG. 7 is a side cross-sectional view of the fluid end and other components of the reciprocating pump illustrated in FIG. 5 taken along line "A-A".

Referring now to FIG. 7, a cross-sectional side view of the reciprocating pump 300 taken along line "A-A" in FIG. 5 is illustrated. The fluid end 320 of the reciprocating pump 300 is illustrated along with a portion of a reciprocating member 315, such as a plunger, and is associated gland nut 316 and packing 318. Bore 330 in the fluid end casing 322 is closed by a valve cover 332 that is retained in place and secured by a threaded retainer 334 which is engaged by a nut 336. One or more fasteners 338 are used to hold the nut 336 in place.

Bore 340 is fluidically coupled to a discharge manifold 348. A valve body or valve component 350 is provided with a spring 352 that biased the valve component 350 to its closed position. A discharge bore cover 354 is held in place by a threaded retainer 356.

Bore 360 is fluidically coupled to a suction manifold port 368. Located in bore 360 is a valve component 370 that is biased into its closed position by a spring 372. In its closed position, valve component 370 engages a valve seat 374 in bore 360.

In the cross-sectional view shown in FIG. 7, couplers 432 and 442 are illustrated. In this configuration, the couplers 432 and 442 extend from the power end and through the fluid end casing 322. The outer ends of the couplers 432 and 442 extend from the exterior surface 324 of the fluid end casing 322. Fasteners 452 and 462, such as nuts, are engaged with the couplers 432 and 442, respectively, to secure the fluid end casing 322 on the couplers 432 and 442 and to the power end.

Figure 8:
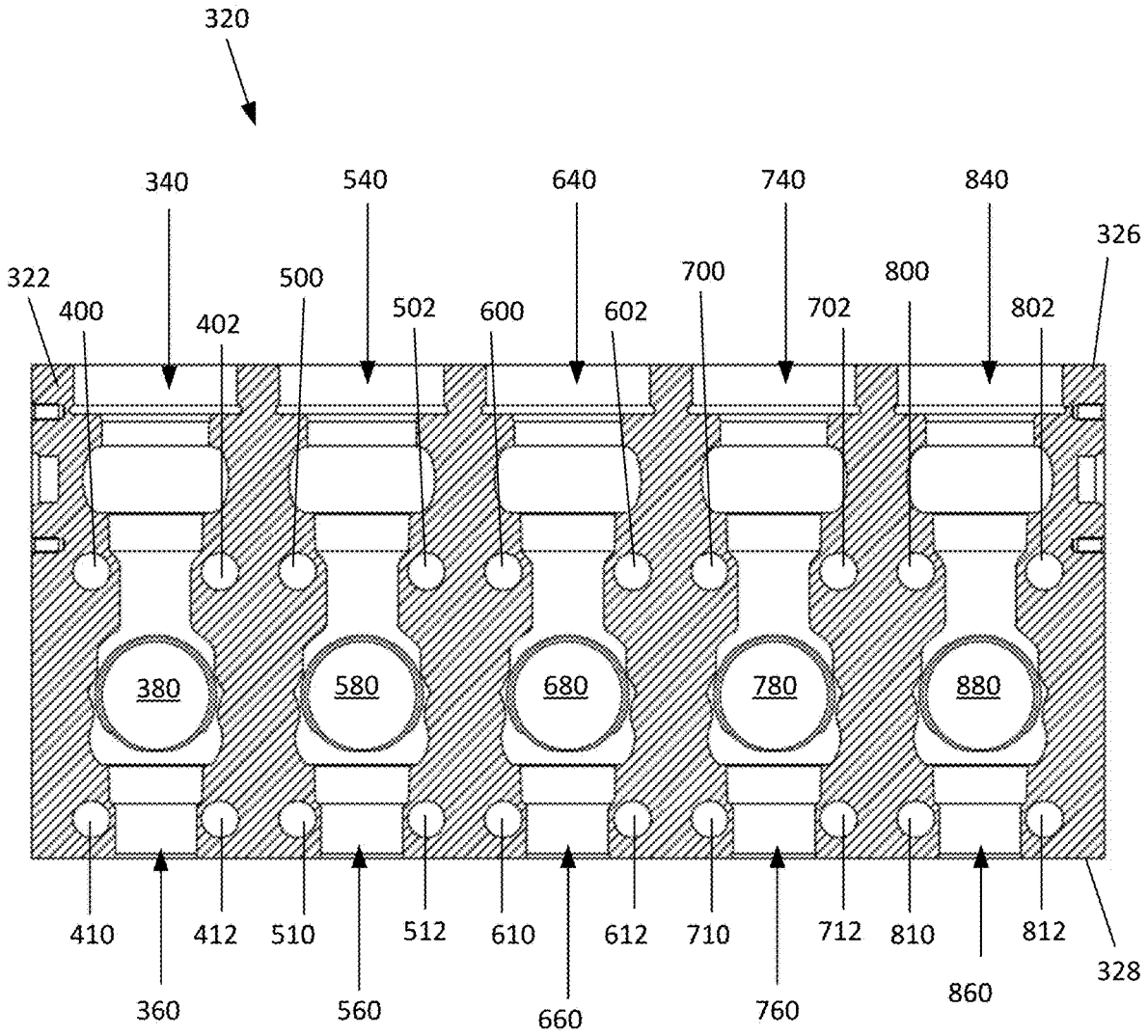
FIG. 8 is a front cross-sectional view of the fluid end of the reciprocating pump illustrated in FIG. 4 with the valves and stay rods removed.
Figure 9:
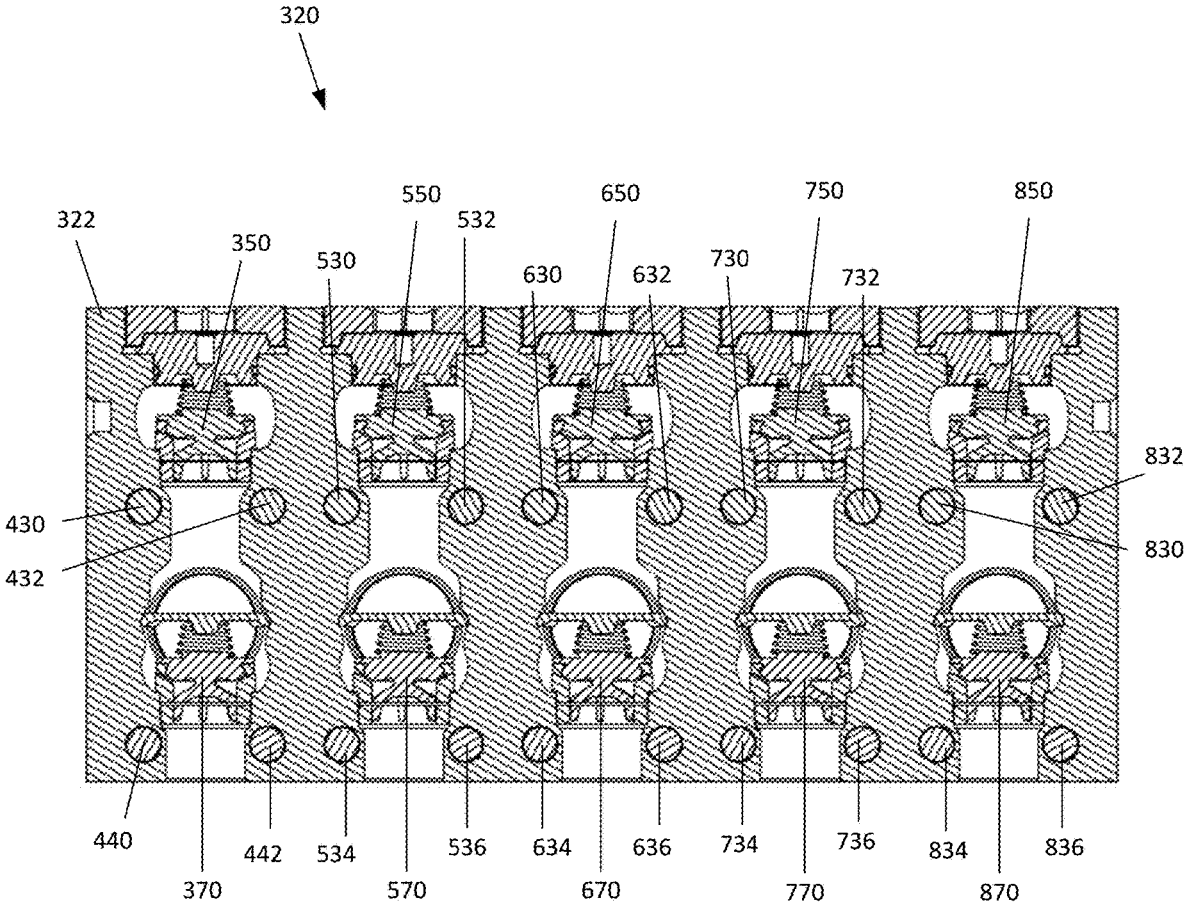
FIG. 9 is a front cross-sectional view of the fluid end of the reciprocating pump illustrated in FIG. 4 with the valves and stay rods illustrated.
Figure 10:
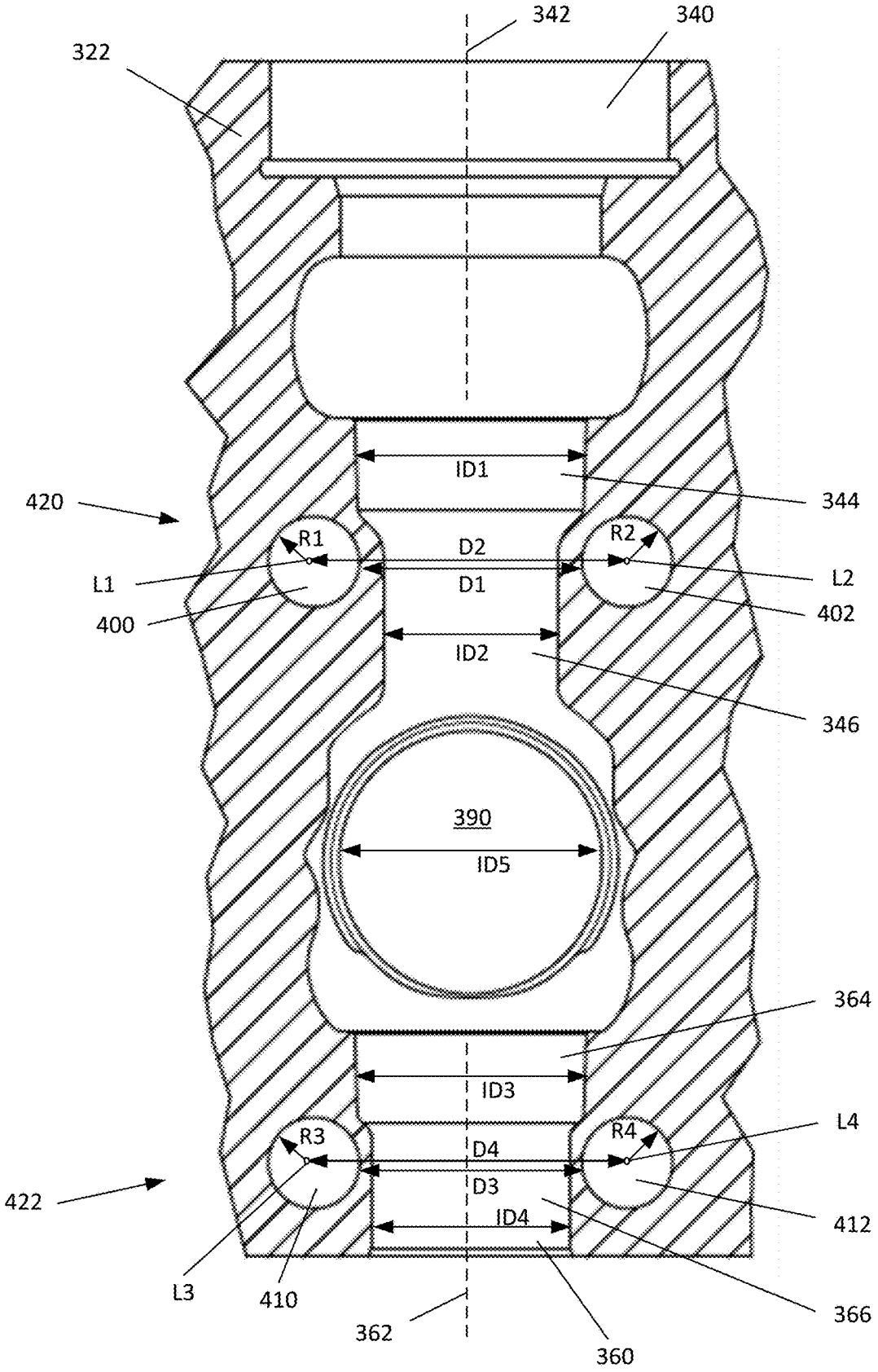
FIG. 10 is a partial front cross-sectional view of the fluid end of the reciprocating pump illustrated in FIG. 4.

Turning to FIGS. 8-10, different views of the fluid end casing 322 of the fluid end 320 are illustrated. Initially referring to FIG. 8, the fluid end casing 322 has a top or upper end 326 and a lower or bottom end 328 when it is mounted to the power end of the reciprocating pump 300. In this embodiment, fluid end casing 322 is illustrated with five different sets of bores. It is to be understood that in different embodiments, the quantity of sets of bores can vary. For example, a fluid end may have a single set of bores or several sets of bores, including but not limited to, three sets or four sets. Also, in different embodiments, the fluid end casing 322 can be modular and can include several different fluid end casing portions, each of which has one or more sets of bores, that can be coupled together to form the fluid end.

In FIG. 8, the various valve components and couplers have been removed from the fluid end casing 322 to simplify the illustration of features of the fluid end casing 322. In this embodiment, fluid end casing 322 includes several variable diameter bores 340, 540, 640, 740, and 840 that are discharge bores, and several variable diameter bores 360, 560, 660, 760, and 860 that are suction bores, each of which is aligned with a corresponding one of the discharge bores. Bores 340 and 360 intersect at a center bore or cross bore 380. Similarly, corresponding pairs of bores 540 and 560, 640 and 660, 740 and 760, and 840 and 860 intersect at a cross bore 580, 680, 780, and 880, respectively.

Fluid end casing 322 includes a first pair of holes or through holes 400 and 402 that extend through the fluid end casing 322. The holes 400 and 402 are parallel to each other and are located on opposite sides of bore 340. The fluid end casing 322 includes a second pair of holes or through holes 410 and 412 that extend through the fluid end casing 322. The holes 410 and 412 are parallel to each other and are located on opposite sides of bore 360. As described in greater detail below, the holes 400, 402, 410, and 412 are sized to receive couplers, such as tie rods, therethrough that couple the fluid end casing 322 to the power end 310.

The other bore sets formed in the fluid end casing 322 have similar pairs of through holes relative to the bores. As illustrated in FIG. 8, through holes 500 and 502 are located on opposite sides of bore 540 and through holes 510 and 512 are located on opposite sides of bore 560. Through holes 600 and 602 are located on opposite sides of bore 640 and through holes 610 and 612 are located on opposite sides of bore 660. Similarly, through holes 700 and 702 are located on opposite sides of bore 740 and through holes 710 and 712 are located on opposite sides of bore 760. Also, through holes 800 and 802 are located on opposite sides of bore 840 and through holes 810 and 812 are located on opposite sides of bore 860.

While in this embodiment, the relative distances or spacing between a pair of holes on opposite sides of a bore are the same for the different pairs of through holes, in different embodiments, the relative distances or spacing between pairs of holes can vary. In addition, in different embodiments, the sizes of the through holes located on opposite sides of a bore can vary. Also, some of the through holes in a fluid end casing can have different sizes (diameters) as compared to some of the other through holes in the fluid end casing.

Turning to FIG. 9, the various valve components and the couplers are illustrated relative to fluid end casing 322 of the fluid end 320. Bores 340 and 360 have valve components 350 and 370, respectively. Similarly, the other sets of bores have valve components 550 and 570, 650 and 670, 750 and 770, and 850 and 870.

Also shown in FIG. 9 are the various stay rods that are inserted into the fluid end casing. As shown, stay rods 430 and 432 are inserted into through holes 400 and 402, respectively, and are located on opposite sides of bore 340. Stay rods 440 and 442 are inserted into through holes 410 and 412, respectively, and are located on opposite sides of bore 360. As will be described relative to FIG. 10 below, the distances between sets of through holes and openings relate to the inner diameter of the associated proximate bore sections.

In this embodiment, fluid end casing 322 receives various sets of stay rods relative to its other bores. Stay rods 530 and 532 are located on opposite sides of bore 540, and stay rods 534 and 536 are located on opposite sides of bore 560. Similarly, stay rods 630 and 632 are located on opposite sides of bore 640, and stay rods 634 and 636 are located on opposite sides of bore 660. Also, stay rods 730 and 732 are located on opposite sides of bore 740, and stay rods 734 and 736 are located on opposite sides of bore 760. Finally, stay rods 830 and 832 are located on opposite sides of bore 840, and stay rods 834 and 836 are located on opposite sides of bore 860.

In FIG. 10, the bores 340 and 360 and its associated through holes are described in detail. It is to be understood that the description of bores 340 and 360 and holes 400, 402, 410, and 412 corresponds to the other sets of bores and holes as well.

In FIG. 10, a portion of fluid end casing 322 is illustrated. Bore 340 has a longitudinal axis 342 and bore 360 has a longitudinal axis 362. In this embodiment, longitudinal axis 342 is coaxial or colinear with longitudinal axis 362. Bore 340 is a variable diameter bore with several different sections or portions. Bore 340 has a first portion 344 that has a first inner diameter ID1 and a second portion 346 that has a second inner diameter ID2. In this embodiment, the second inner diameter ID2 is smaller than the first inner diameter ID1.

Proximate to bore 340 is a pair 420 of holes or through holes 400 and 402. Hole 400 includes a longitudinal axis L1 and a radius R1, and hole 402 includes a longitudinal axis L2 and a radius R2. The holes 400 and 402 are spaced apart from each other by a distance D1. Distance D1 is located in a plane that is the same plane as second inner diameter ID2. The distance D1 between the holes 400 and 402 can also be determined a different way. Distance D1 is calculated by determining the distance D2 between the longitudinal axes L1 and L2 and subtracting the radii R1 and R2 from that distance. By providing portion 346 with an inner diameter ID2 that is less than the inner diameter ID1 of bore portion 344, the through holes 400 and 402 can be located at a distance that matches the spacing of tie rods extending from the power end.

Similarly, bore 360 is a variable diameter bore with several different sections or portions. Bore 360 has a first portion 364 that has a first inner diameter ID3 and a second portion 366 that has a second inner diameter ID4. In this embodiment, the second inner diameter ID4 is smaller than the first inner diameter ID3. Proximate to bore 360 is a pair 422 of holes or through holes 410 and 412. Hole 410 includes a longitudinal axis L3 and a radius R3, and hole 412 includes a longitudinal axis L4 and a radius R4. The holes 410 and 412 are spaced apart from each other by a distance D3. The distance D3 between the holes 410 and 412 can also be calculated by determining the distance D4 between the longitudinal axes L3 and L4 and subtracting the radii R3 and R4 from that distance. By providing portion 366 with an inner diameter ID4 that is less than the inner diameter ID3 of bore portion 364, the through holes 410 and 412 can be located at a distance that matches the spacing of tie rods extending from the power end.

In the illustrated embodiment, the distances D1 and D3 are the same so that the first pair 420 of holes are spaced apart the same distance that the second pair 422 of holes are spaced apart. Also, in this embodiment, each of the holes 400, 402, 410, and 412 are similarly sized, making the radii R1, R2, R3, and R4 the same. The distance between longitudinal axes L1 and L2 is the same as the distance between longitudinal axes L3 and L4. In alternative embodiments, the sizes of the holes 400, 402, 410, and 412 can vary, depending on the size of the couplers used. In addition, the spacing between the pairs 420 and 422 of the holes can vary.

The plunger bore 390 has an inner diameter ID5, as shown in FIG. 10. In this embodiment, the inner diameter ID5 is larger than either of the distance D1 between holes 400 and 402 or the distance D3 between holes 410 and 412. As a result, the pairs of holes 400, 402, 410, and 412 can be placed closer to each other than the larger diameter portions 344, 364 and plunger bore 390, which allows the fluid end casing 322 to be mounted to any power end that has couplers extending therefrom at that distance.

Figure 11:
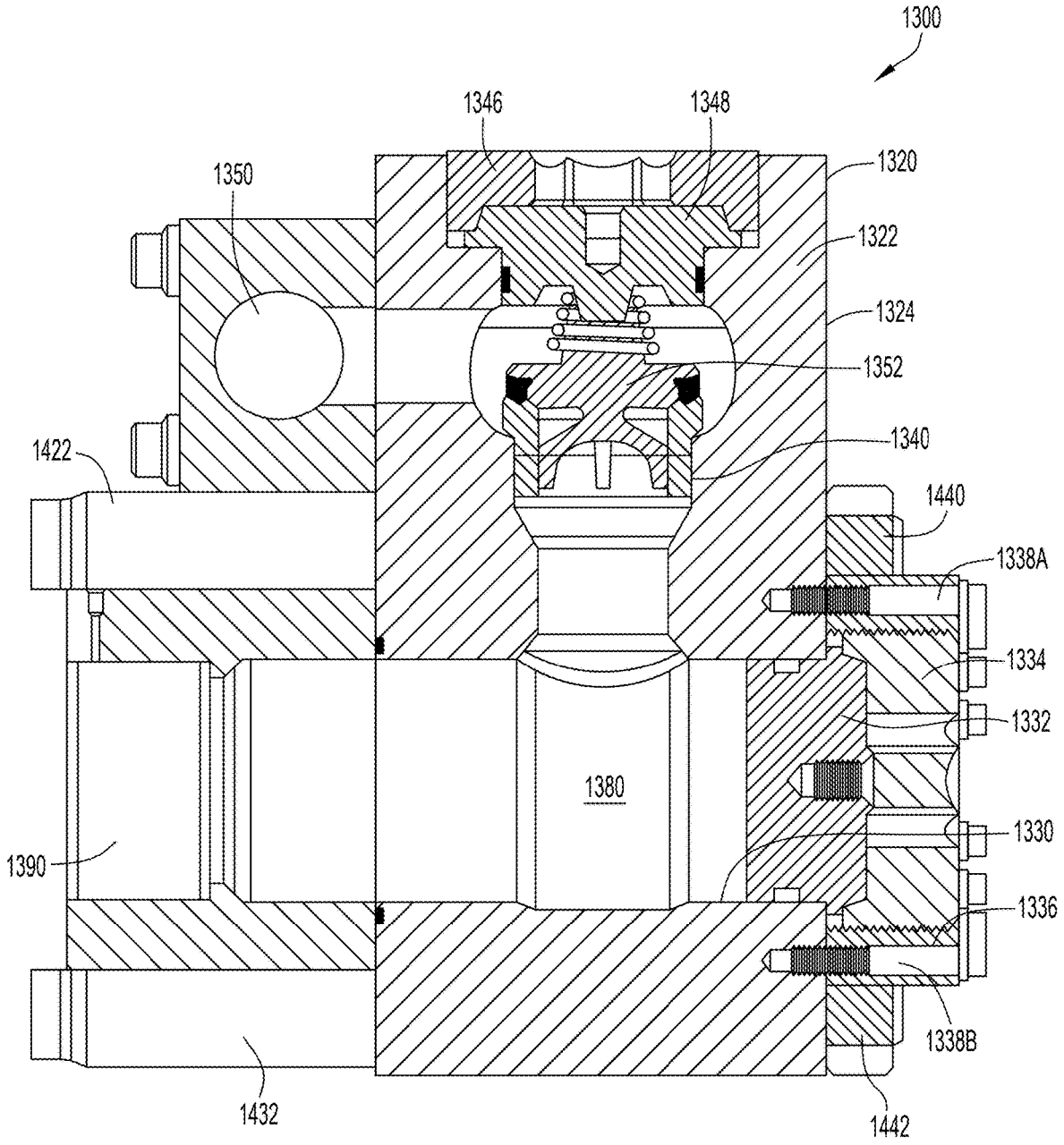
FIG. 11 is a side cross-sectional view of a fluid end and other components of a reciprocating pump, according to another example embodiment of the present application.
Figure 12:
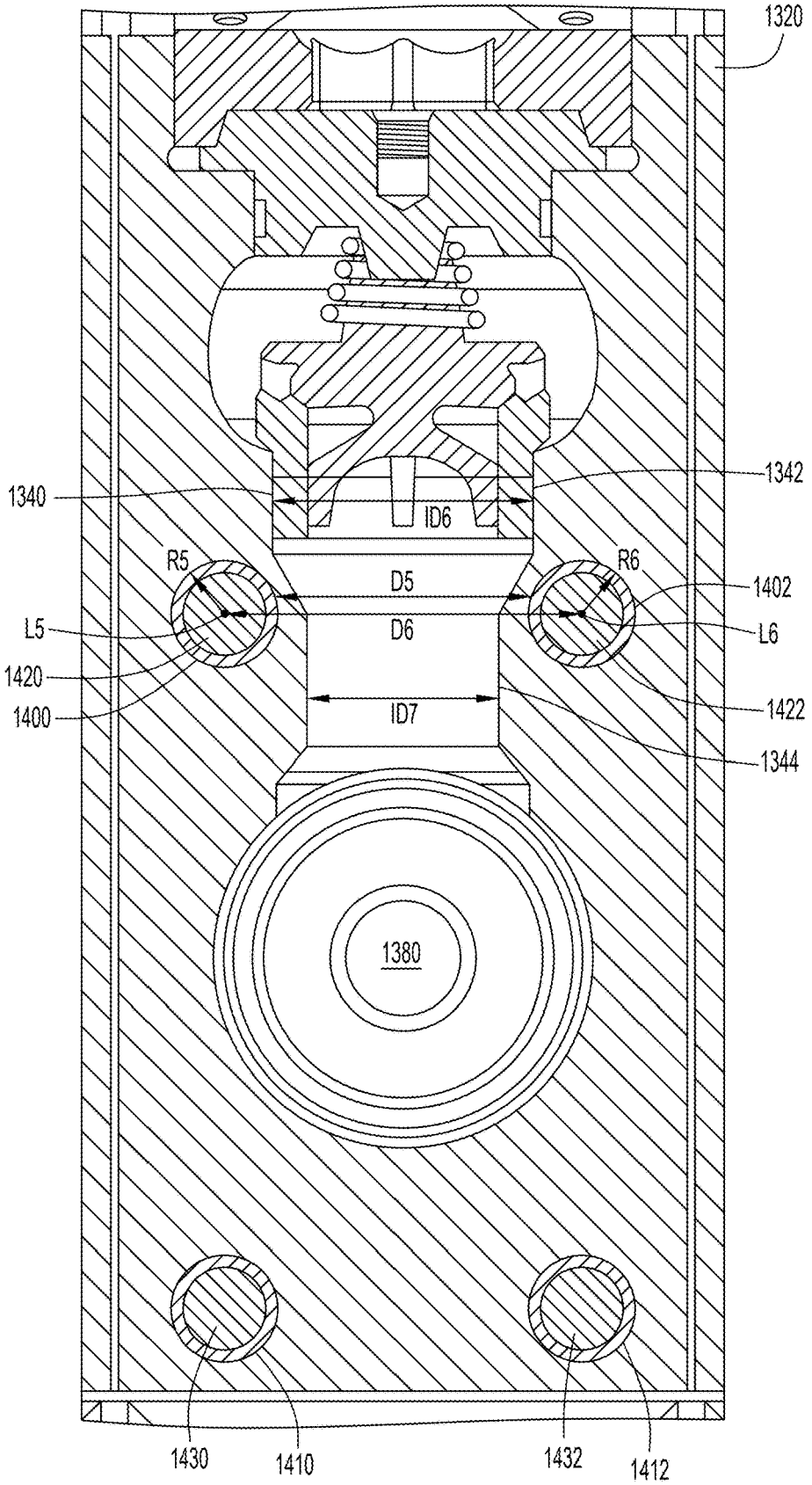
FIG. 12 is a front cross-sectional view of the fluid end illustrated in FIG. 11 with the valves and stay rods illustrated.

Turning to FIGS. 11 and 12, an alternative embodiment of a fluid end casing is illustrated. FIGS. 11 and 12 are different cross-sectional views of fluid end casing 1322 of fluid end 1320 of a reciprocating pump 1300 is shown. The fluid end casing 1322 includes a bore 1330 with a valve cover 1332 that is held in place by a retainer 1334 and a nut 1336 with several fasteners, such as bolts 1338A and 1338B.

The fluid end casing 1322 includes a discharge bore 1340, which is a variable diameter bore. Bore 1340 has a first bore portion 1342 with an inner diameter ID6 and a second bore portion 1344 with an inner diameter ID7. A discharge cover 1346 and a threaded retainer 1348 are provided in bore 1340. Bore 1340 is in fluid communication with discharge manifold 1350. A valve body or component 1352 is provided in bore 1340 as well. The fluid end casing 1322 also includes a cross bore 1380 and a plunger bore 1390.

In FIG. 11, couplers 1422 and 1432 are shown extending through the fluid end casing 1322. The external or outer ends of the couplers 1422 and 1432 extend from the external surface 1324 and have fasteners 1440 and 1442, respectively, coupled thereto.

Turning to FIG. 12, the fluid end casing 1322 has holes 1400, 1402, 1410, and 1412 formed therein. Couplers 1420, 1422, 1430, and 1432 extend through holes 1400, 1402, 1410, and 1412, respectively. While only holes 1400 and 1402 are described in detail relative to FIG. 12, the same description applies to holes 1410 and 1412.

Hole 1400 has a longitudinal axis L5 and a radius R5, and holes 1402 has a longitudinal axis L6 and a radius R6. Hole 1402 is spaced apart from hole 1400 by a distance D5, which is less than inner diameter ID6 and greater than inner diameter ID7. The distance between holes 1400 and 1402 can be calculated by measuring the distance D6 between longitudinal axes L5 and L6 and subtracting the radii R5 and R6.

As stated above, the present application is also directed to a relationship in a fluid end casing of several different dimensions. The relationship of the dimensions is used to identify acceptable fluid end designs that can be used with tie rods that have an industry standard spacing between them. An acceptable fluid end design is one that can be mounted onto standard spaced tie rods, and also enable a sufficient fluid flow through the bores and valve components in the fluid end. The certain dimension relationship has been identified that can be used to characterize acceptable fluid end designs is described in detail below.

The dimension relationship of a spacing between a pair of tie rods, a diameter of a plunger bore, and a flow area of a valve seat has been identified. In an aspect of this application, the flow area of a valve seat is calculated based on an inner diameter of the valve seat, which is defined by an inner surface of the valve seat. The spacing between a pair of tie rods is a standard distance throughout the industry. The diameter of a plunger bore can be selected based on the desired functioning of the pump. Certain plunger bore diameters are identified in the examples below.

Figure 13:
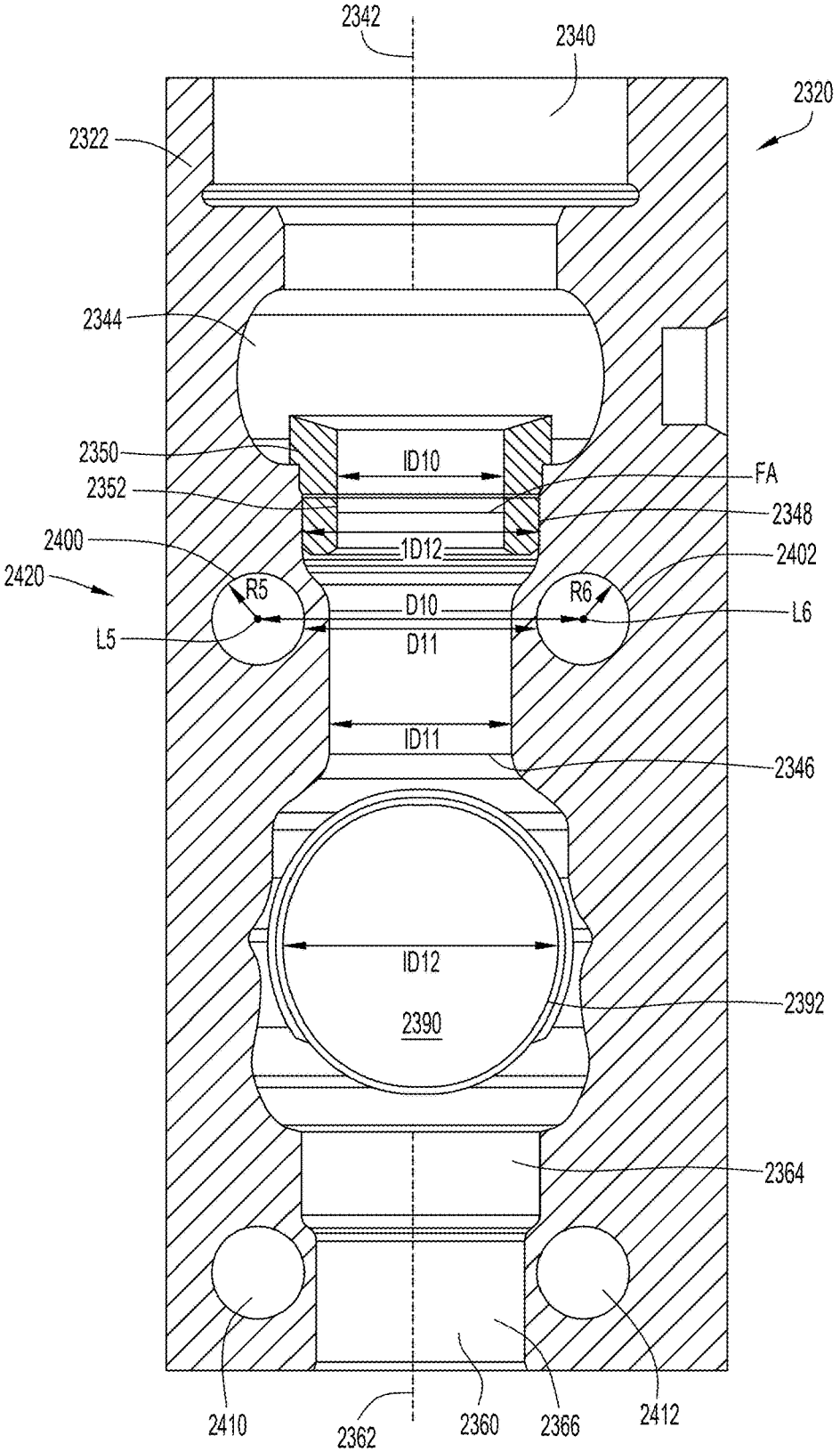
FIG. 13 is a front cross-sectional view of another embodiment of a fluid end casing with stay rods not illustrated.
Figure 14:
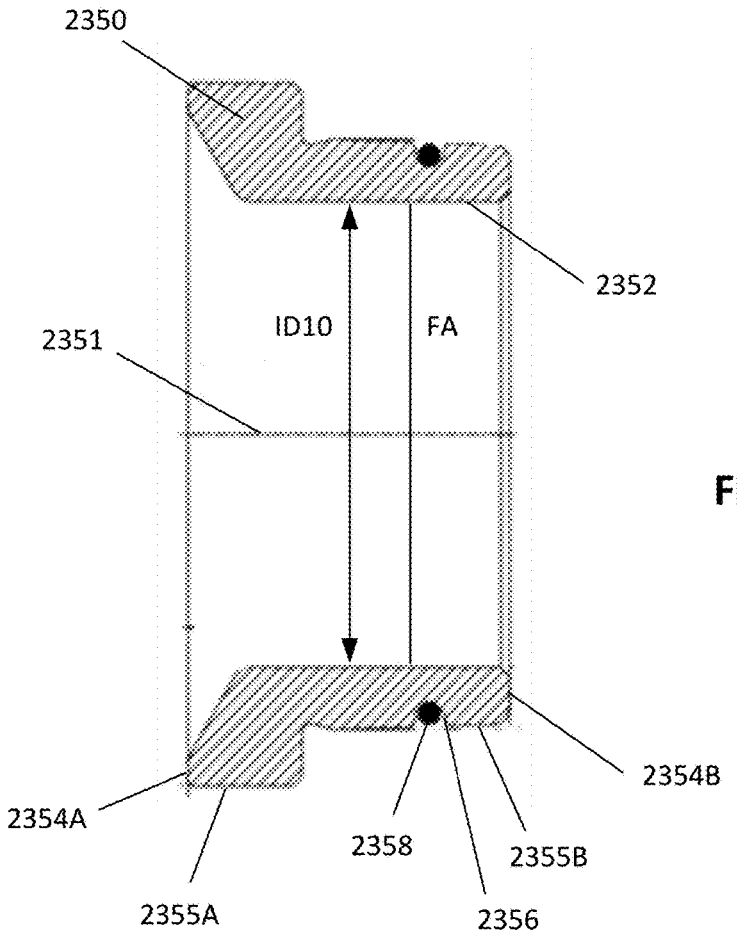
FIG. 14 is a side cross-sectional view of a valve seat of the fluid end casing illustrated in FIG. 13.
Figure 15:
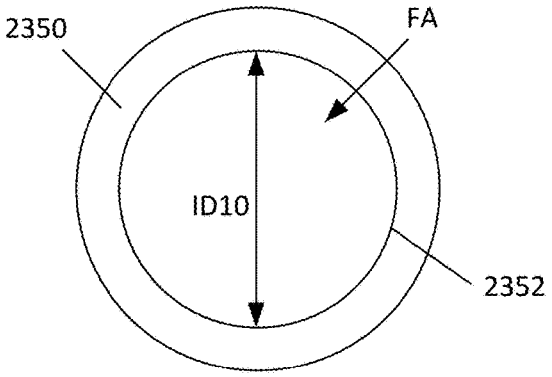
FIG. 15 is a top view of the valve seat illustrated in FIG. 14.

Referring to FIGS. 13-15, different views of an alternative embodiment of a fluid end casing according to an aspect of the invention is illustrated. Referring to FIG. 13, the fluid end 2320 includes a fluid end casing 2322, a portion of which is illustrated in the cross-sectional view of FIG. 13. The fluid end casing 2322 includes a bore 2340 formed therein. The bore 2340 is a discharge or outlet bore, which in some embodiments may be a variable diameter bore. Bore 2340 has a longitudinal axis 2342 and is fluidically coupled to a discharge manifold 2344.

Bore 2340 includes a bore portion 2346 that has an inner diameter ID11, and a different bore portion 2348 that has an inner diameter ID12. Located in bore portion 2348 is a valve seat 2350. The valve seat 2350 has an inner surface 2352 defining an inner diameter ID10 of the valve seat 2350. The inner diameter ID10 is used to calculate a flow area FA which extends across a bore of the valve seat 2350. The flow area FA can be referred to alternatively as a throat of the valve seat. As discussed below, the inner diameter ID10 of the valve seat 2350 is used in the calculation of the flow area FA that is used in the dimension relationship calculation.

The fluid end casing 2322 includes a plunger bore 2390. The plunger bore 2390 has an inner surface 2392 that defines an inner diameter ID12. The inner diameter ID12 of the plunger bore 2390 is used as an input in the dimension relationship calculation for the fluid end casing, as described below.

In one embodiment, the fluid end casing 2322 includes a suction bore 2360 that has a longitudinal axis 2362 and two different sized bore portions 2364 and 2366. Located on opposite sides of the suction bore 2360 are holes or thru holes 2410 and 2412 through which couplers, such as tie rods, are inserted. The thru holes 2410 and 2412 can be referred to alternatively as thru rod holes.

The fluid end casing 2322 also includes holes or thru rod holes 2400 and 2402. The pair 2420 of thru rod holes 2400 and 2402 are located on opposite sides of bore 2340, and they also extend parallel to each other. Thru hole 2400 has a radius R5 and a longitudinal axis L5 that extends perpendicularly to the view illustrated in FIG. 13. The longitudinal axis L5 forms a center point for thru hole 2400. Similarly, thru hole 2402 has a radius R6 and a longitudinal axis L6 that extends parallel to longitudinal axis L5 and perpendicularly to the view illustrated in FIG. 13. The longitudinal axis L6 forms a center point for thru hole 2402.

In this embodiment, the longitudinal axes L5 and L6 are spaced apart by the distance D10, which is referred to as a tie rod spacing. In the pump industry, there are two standard tie rod spacings. In one implementation, the tie rod spacing distance D10 is 6.25 inches. In another implementation, the tie rod spacing distance D10 is 8.25 inches. When the tie rods are cylindrical, the thru holes 2400 and 2402 are cylindrical as well. As a result, the distance D10 can also be determined by adding the distance D11 between the thru rod holes 2400 and 2402 to the sum of radii R5 and R6.

Referring to FIGS. 14 and 15, a cross-sectional side view and a top view of the valve seat 2350 are shown, respectively. As described above, the valve seat 2350 has an inner surface 2352 that defines an inner diameter ID10 that is used to calculate the flow area FA of the valve seat 2350. The flow area FA is defined by a plane that extends across the valve seat 2350.

The valve seat 2350 has a longitudinal axis 2351 and opposite ends 2354A and 2354B, as shown in FIG. 14. The valve seat 2350 also has outer surfaces 2355A and 2355B that have different outer diameters. In addition, while outer surface 2355A extends parallel to the longitudinal axis 2351, outer surface 2355B is slightly tapered inwardly toward the longitudinal axis 2351 as it extends from its end near outer surface 2355A to end 2354B. Outer surface 2355B also has a groove 2356 with a sealing member 2358 disposed therein. The sealing member 2358 engages the inner surface of bore portion 2348 (see FIG. 13) when the valve seat 2350 is inserted into bore 2340.

In different implementations, the diameter of a plunger bore can vary in different fluid end casings. The present application relates to a range of plunger bore diameters from 2 inches to 8 inches. For each of the plunger bore diameters, the inner diameter of the valve seat can vary as well. In different embodiments, the plunger bore diameter can be any of 2 inches, 4 inches, 4.5 inches, 4.75 inches, 5 inches, or 8 inches. For each of those plunger bore diameters, the inner diameter of the valve seat is in the range from 2 inches to 6 inches, and can be any distance therebetween in 0.25 inch increments.

The relationship in a fluid end casing between the inner diameter of a plunger bore and the inner diameter of a valve seat is calculated and used to reflect different fluid end casing embodiments that are designed to engage industry standard spaced tie rods to mount the fluid end to a power end while enabling a satisfactory fluid flow through the fluid end. As mentioned above, the couplers, such as tie rods or stay rods, are spaced apart in the pump industry by one of two different distances. In one implementation, the tie rod spacing distance is about 6.25 inches. In another implementation, the tie rod spacing distance is about 8.25 inches. The term "about" as used herein in relation to a described amount indicates that the amount, such as a distance, can deviate or vary slightly beyond the described value by +/−0.25 inches.

Several examples are provided below to show the relationship between the inner diameter of a plunger bore and the inner diameter of a valve seat in a fluid end. In the examples, the plunger bore diameter is changed and a range of acceptable valve seat inner diameters are used in the calculation of ratios that represent acceptable dimensional configurations for a fluid end casing.

In one aspect, there are three steps to the calculations set forth below. Prior to the first step, three dimensions are determined and used as inputs. One input dimension is the spacing between tie rods, which is determined by measuring the distance between the longitudinal axes of the thru holes for a pair of tie rods. As mentioned above, the industry standard distance between the longitudinal axes of a pair of tie rods can be 6.25 inches in one implementation, and can be 8.25 inches in another implementation.

Another input dimension is the inner diameter of the plunger bore in inches. In different embodiments, the plunger bore inner diameter is in the range from about 2.0 inches to about 8.0 inches. The various embodiments and examples set forth below include plunger bore inner diameters of 2.0 inches, 4.0 inches, 4.5 inches, 4.75 inches, 5.0 inches, and 8.0 inches for each of the different tie rod spacing distances of 6.25 inches and 8.25 inches. It is to be understood that the plunger bore inner diameter can be any other intermediate dimension in the range from about 2.0 inches to about 8.0 inches, in addition to those described in the examples below.

The third input dimension is inner diameter of the valve seat in inches. In different embodiments, the valve seat inner diameter is in the range from about 2.0 inches to about 6.0 inches. The various embodiments set forth below include changing the valve seat inner diameter at 0.25 inch increments. However, it is to be understood that the valve seat inner diameter is not required to be a standard dimension, and that in various embodiments, the valve seat inner diameter can vary. For example, the valve seat inner diameters in different embodiments can be irregular dimensions, such as 3.03 inches. Accordingly, the examples below and the valve seat inner diameter range described herein cover the range from about 2.0 inches to about 6.0 inches and can be any dimension in that range. The 0.25 inch increments in the examples below are exemplary dimensions in that range.

Once a plunger bore inner diameter is selected, the flow area of the valve seat is calculated for each of the valve seat inner diameters in the range. A first ratio, referred to as ratio A, is calculated by dividing the plunger bore inner diameter (in inches) by the flow area (in inches$^2$) that is calculated using the valve seat inner diameter. Ratio A is then multiplied by the spacing between a pair of tie rods, which is 6.25 inches in Examples 1 through 6 and is 8.25 inches in Examples 7 through 12, resulting in another ratio, referred to as ratio B.

EXAMPLES

Example 1—Plunger Bore Inner Diameter=2.0 Inches

In this example, the plunger bore inner diameter is about 2.0 inches. The first column entitled "Flow Diameter of Valve Seat" represents the inner diameter of the valve seat in inches. That inner diameter is used to calculate the flow area of the valve seat, which is included in the second column entitled "Flow Area of Valve Seat." Next, the values in the third column entitled "Ratio A=(Plunger Bore Diameter)/(Flow Area)" are calculated by dividing the plunger bore diameter, which in this Example 1 is about 2.0 inches, by the calculated flow area from the second column. The resulting number is in units of 1/inches. The value in the third column is then multiplied by the tie rod spacing distance of 6.25 inches to calculate the value in the fourth column, which is entitled "Ratio B=(Ratio A)*(Tie Rod Spacing)."

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 0.64 | 3.98 |
| 2.25 | 3.98 | 0.50 | 3.14 |
| 2.5 | 4.91 | 0.41 | 2.55 |
| 2.75 | 5.94 | 0.34 | 2.10 |
| 3 | 7.07 | 0.28 | 1.77 |
| 3.25 | 8.30 | 0.24 | 1.51 |
| 3.5 | 9.62 | 0.21 | 1.30 |
| 3.75 | 11.04 | 0.18 | 1.13 |
| 4 | 12.57 | 0.16 | 0.99 |
| 4.25 | 14.19 | 0.14 | 0.88 |
| 4.5 | 15.90 | 0.13 | 0.79 |
| 4.75 | 17.72 | 0.11 | 0.71 |
| 5 | 19.63 | 0.10 | 0.64 |
| 5.25 | 21.65 | 0.09 | 0.58 |
| 5.5 | 23.76 | 0.08 | 0.53 |
| 5.75 | 25.97 | 0.08 | 0.48 |
| 6 | 28.27 | 0.07 | 0.44 |

As shown in the data above, the valve seat flow diameter is in the range from about 2.0 inches to about 6.0 inches. For each of the different valve seat flow diameters and a plunger bore inner diameter of about 2.0 inches, the resulting ratio is less than 4.0, and more particularly, the resulting ratio is in the range from 3.98 (at a valve seat flow diameter of 2.0 inches) to 0.44 (at a valve seat flow diameter of 6.0 inches). The range of valve seat flow diameters from about 2.0 inches to about 6.0 inches is an acceptable range of valve seats that can be used with a fluid end casing having a plunger bore of about 2.0 inches.

Example 2—Plunger Bore Inner Diameter=4.0 Inches

In this example, the plunger bore inner diameter is about 4.0 inches. The range of valve seat flow diameters from about 2.0 inches to about 6.0 inches below is an acceptable range of valve seats that can be used with a fluid end casing having a plunger bore of about 4.0 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.27 | 7.96 |
| 2.25 | 3.98 | 1.01 | 6.29 |
| 2.5 | 4.91 | 0.81 | 5.09 |
| 2.75 | 5.94 | 0.67 | 4.21 |
| 3 | 7.07 | 0.57 | 3.54 |
| 3.25 | 8.30 | 0.48 | 3.01 |
| 3.5 | 9.62 | 0.42 | 2.60 |
| 3.75 | 11.04 | 0.36 | 2.26 |
| 4 | 12.57 | 0.32 | 1.99 |
| 4.25 | 14.19 | 0.28 | 1.76 |
| 4.5 | 15.90 | 0.25 | 1.57 |
| 4.75 | 17.72 | 0.23 | 1.41 |
| 5 | 19.63 | 0.20 | 1.27 |
| 5.25 | 21.65 | 0.18 | 1.15 |
| 5.5 | 23.76 | 0.17 | 1.05 |
| 5.75 | 25.97 | 0.15 | 0.96 |
| 6 | 28.27 | 0.14 | 0.88 |

As shown in the data above, the valve seat flow diameter is in the range from about 2.0 inches to about 6.0 inches. For each of the different valve seat flow diameters and a plunger bore inner diameter of about 4.0 inches, the resulting ratio is less than 8.0, and more particularly, the resulting ratio is in the range from 7.96 (at a valve seat flow diameter of 2.0 inches) to 0.88 (at a valve seat flow diameter of 6.0 inches).

Example 3—Plunger Bore Inner Diameter=4.5 Inches

In this example, the plunger bore inner diameter is about 4.5 inches. The range of valve seat flow diameters from about 2.0 inches to about 6.0 inches below is an acceptable range of valve seats that can be used with a fluid end casing having a plunger bore of about 4.5 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.43 | 8.95 |
| 2.25 | 3.98 | 1.13 | 7.07 |
| 2.5 | 4.91 | 0.92 | 5.73 |
| 2.75 | 5.94 | 0.76 | 4.74 |
| 3 | 7.07 | 0.64 | 3.98 |
| 3.25 | 8.30 | 0.54 | 3.39 |
| 3.5 | 9.62 | 0.47 | 2.92 |
| 3.75 | 11.04 | 0.41 | 2.55 |
| 4 | 12.57 | 0.36 | 2.24 |
| 4.25 | 14.19 | 0.32 | 1.98 |
| 4.5 | 15.90 | 0.28 | 1.77 |
| 4.75 | 17.72 | 0.25 | 1.59 |
| 5 | 19.63 | 0.23 | 1.43 |
| 5.25 | 21.65 | 0.21 | 1.30 |
| 5.5 | 23.76 | 0.19 | 1.18 |
| 5.75 | 25.97 | 0.17 | 1.08 |
| 6 | 28.27 | 0.16 | 0.99 |

As shown in the data above, for each of the different valve seat flow diameters and a plunger bore inner diameter of 4.50 inches, the resulting ratio is less than 9.0, and more particularly, the resulting ratio is in the range from 8.95 (at a valve seat flow diameter of 2.0 inches) to 0.99 (at a valve seat flow diameter of 6.0 inches).

Example 4—Plunger Bore Inner Diameter=4.75 Inches

In this example, the plunger bore inner diameter is about 4.75 inches. The range of valve seat flow diameters from about 2.0 inches to about 6.0 inches below is an acceptable range of valve seats that can be used with a fluid end casing having a plunger bore of about 4.75 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.51 | 9.45 |
| 2.25 | 3.98 | 1.19 | 7.47 |
| 2.5 | 4.91 | 0.97 | 6.05 |
| 2.75 | 5.94 | 0.80 | 5.00 |
| 3 | 7.07 | 0.67 | 4.20 |
| 3.25 | 8.30 | 0.57 | 3.58 |
| 3.5 | 9.62 | 0.49 | 3.09 |
| 3.75 | 11.04 | 0.43 | 2.69 |
| 4 | 12.57 | 0.38 | 2.36 |
| 4.25 | 14.19 | 0.33 | 2.09 |
| 4.5 | 15.90 | 0.30 | 1.87 |
| 4.75 | 17.72 | 0.27 | 1.68 |
| 5 | 19.63 | 0.24 | 1.51 |
| 5.25 | 21.65 | 0.22 | 1.37 |
| 5.5 | 23.76 | 0.20 | 1.25 |
| 5.75 | 25.97 | 0.18 | 1.14 |
| 6 | 28.27 | 0.17 | 1.05 |

As shown in the data above, for each of the different valve seat flow diameters and a plunger bore inner diameter of about 4.75 inches, the resulting ratio is less than 9.5, and more particularly, the resulting ratio is in the range from 9.45 (at a valve seat flow diameter of 2.0 inches) to 1.05 (at a valve seat flow diameter of 6.0 inches).

Example 5—Plunger Bore Inner Diameter=5.0 Inches

In this example, the plunger bore inner diameter is about 5.0 inches. The range of valve seat flow diameters from about 2.0 inches to about 6.0 inches below is an acceptable range of valve seats that can be used with a fluid end casing having a plunger bore of about 5.0 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.59 | 9.95 |
| 2.25 | 3.98 | 1.26 | 7.86 |
| 2.5 | 4.91 | 1.02 | 6.37 |
| 2.75 | 5.94 | 0.84 | 5.26 |
| 3 | 7.07 | 0.71 | 4.42 |
| 3.25 | 8.30 | 0.60 | 3.77 |
| 3.5 | 9.62 | 0.52 | 3.25 |
| 3.75 | 11.04 | 0.45 | 2.83 |
| 4 | 12.57 | 0.40 | 2.49 |
| 4.25 | 14.19 | 0.35 | 2.20 |
| 4.5 | 15.90 | 0.31 | 1.96 |
| 4.75 | 17.72 | 0.28 | 1.76 |
| 5 | 19.63 | 0.25 | 1.59 |
| 5.25 | 21.65 | 0.23 | 1.44 |
| 5.5 | 23.76 | 0.21 | 1.32 |
| 5.75 | 25.97 | 0.19 | 1.20 |
| 6 | 28.27 | 0.18 | 1.11 |

As shown in the data above, for each of the different valve seat flow diameters and a plunger bore inner diameter of about 5.0 inches, the resulting ratio is less than 10, and more particularly, the resulting ratio is in the range from 9.95 (at a valve seat flow diameter of 2.0 inches) to 1.11 (at a valve seat flow diameter of/6.0 inches).

Example 6. —Plunger Bore Inner Diameter=8.0 Inches

In this example, the plunger bore inner diameter is about 8.0 inches. The range of valve seat flow diameters from about 2.0 inches to about 6.0 inches below is an acceptable range of valve seats that can be used with a fluid end casing having a plunger bore of about 8.0 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 2.55 | 15.92 |
| 2.25 | 3.98 | 2.01 | 12.58 |
| 2.5 | 4.91 | 1.63 | 10.19 |
| 2.75 | 5.94 | 1.35 | 8.42 |
| 3 | 7.07 | 1.13 | 7.07 |
| 3.25 | 8.30 | 0.96 | 6.03 |
| 3.5 | 9.62 | 0.83 | 5.20 |
| 3.75 | 11.04 | 0.72 | 4.53 |
| 4 | 12.57 | 0.64 | 3.98 |
| 4.25 | 14.19 | 0.56 | 3.52 |
| 4.5 | 15.90 | 0.50 | 3.14 |
| 4.75 | 17.72 | 0.45 | 2.82 |
| 5 | 19.63 | 0.41 | 2.55 |
| 5.25 | 21.65 | 0.37 | 2.31 |
| 5.5 | 23.76 | 0.34 | 2.10 |
| 5.75 | 25.97 | 0.31 | 1.93 |
| 6 | 28.27 | 0.28 | 1.77 |

As shown in the data above, for each of the different valve seat flow diameters and a plunger bore inner diameter of about 8.0 inches, the resulting ratio is less than 16, and more particularly, the resulting ratio is in the range from 15.92 (at a valve seat flow diameter of 2.0 inches) to 1.77 (at a valve seat flow diameter of 6.0 inches).

In view of the ranges of valve seat inner diameter being the same in the six examples above, the variable in Examples 1-6 is the plunger bore inner diameter. The calculated ratio, which is referred to as Ratio B, is in the range from 0.44 (for a plunger bore diameter of 2.0 inches and a valve seat inner diameter of 6.0 inches) to 15.92 (for a plunger bore diameter of 8.0 inches and a valve seat inner diameter of 2.0 inches). The embodiments set forth in the above examples are sized to permit a fluid end casing having those dimensions to mounted on and coupled to standard tie rods that have longitudinal axes that are spaced 6.25 inches apart. As noted above in the introduction to this Example section, the tie rod spacing distance for Examples 7 through 12 is 8.25 inches.

Example 7—Plunger Bore Inner Diameter=2.0 Inches

In this example, the plunger bore inner diameter is about 2.0 inches, and the range of valve seat flow diameters is from about 2.0 inches to about 6.0 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 0.64 | 5.25 |
| 2.25 | 3.98 | 0.50 | 4.15 |
| 2.5 | 4.91 | 0.41 | 3.36 |
| 2.75 | 5.94 | 0.34 | 2.78 |
| 3 | 7.07 | 0.28 | 2.33 |
| 3.25 | 8.30 | 0.24 | 1.99 |
| 3.5 | 9.62 | 0.21 | 1.71 |
| 3.75 | 11.04 | 0.18 | 1.49 |
| 4 | 12.57 | 0.16 | 1.31 |
| 4.25 | 14.19 | 0.14 | 1.16 |
| 4.5 | 15.90 | 0.13 | 1.04 |
| 4.75 | 17.72 | 0.11 | 0.93 |
| 5 | 19.63 | 0.10 | 0.84 |
| 5.25 | 21.65 | 0.09 | 0.76 |
| 5.5 | 23.76 | 0.08 | 0.69 |
| 5.75 | 25.97 | 0.08 | 0.64 |
| 6 | 28.27 | 0.07 | 0.58 |

As shown in the data above, for each of the different valve seat flow diameters and a plunger bore inner diameter of about 2.0 inches, the resulting ratio is less than 5.3, and more particularly, the resulting ratio is in the range from 5.25 (at a valve seat flow diameter of 2.0 inches) to 0.58 (at a valve seat flow diameter of 6.0 inches.

Example 8—Plunger Bore Inner Diameter=4.0 Inches

In this example, the plunger bore inner diameter is about 4.0 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.27 | 10.50 |
| 2.25 | 3.98 | 1.01 | 8.30 |
| 2.5 | 4.91 | 0.81 | 6.72 |
| 2.75 | 5.94 | 0.67 | 5.56 |
| 3 | 7.07 | 0.57 | 4.67 |
| 3.25 | 8.30 | 0.48 | 3.98 |
| 3.5 | 9.62 | 0.42 | 3.43 |
| 3.75 | 11.04 | 0.36 | 2.99 |
| 4 | 12.57 | 0.32 | 2.63 |
| 4.25 | 14.19 | 0.28 | 2.33 |
| 4.5 | 15.90 | 0.25 | 2.07 |
| 4.75 | 17.72 | 0.23 | 1.86 |
| 5 | 19.63 | 0.20 | 1.68 |
| 5.25 | 21.65 | 0.18 | 1.52 |
| 5.5 | 23.76 | 0.17 | 1.39 |
| 5.75 | 25.97 | 0.15 | 1.27 |
| 6 | 28.27 | 0.14 | 1.17 |

As shown in the data above, for each of the different valve seat flow diameters and a plunger bore inner diameter of about 4.0 inches, the resulting ratio is less than 11.0, and more particularly, the resulting ratio is in the range from 10.50 (at a valve seat flow diameter of 2.0 inches) to 1.17 (at a valve seat flow diameter of 6.0 inches).

Example 9—Plunger Bore Inner Diameter=4.5 Inches

In this example, the plunger bore inner diameter is about 4.5 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.43 | 11.82 |
| 2.25 | 3.98 | 1.13 | 9.34 |
| 2.5 | 4.91 | 0.92 | 7.56 |
| 2.75 | 5.94 | 0.76 | 6.25 |
| 3 | 7.07 | 0.64 | 5.25 |
| 3.25 | 8.30 | 0.54 | 4.48 |
| 3.5 | 9.62 | 0.47 | 3.86 |
| 3.75 | 11.04 | 0.41 | 3.36 |
| 4 | 12.57 | 0.36 | 2.95 |
| 4.25 | 14.19 | 0.32 | 2.62 |
| 4.5 | 15.90 | 0.28 | 2.33 |
| 4.75 | 17.72 | 0.25 | 2.10 |
| 5 | 19.63 | 0.23 | 1.89 |
| 5.25 | 21.65 | 0.21 | 1.71 |
| 5.5 | 23.76 | 0.19 | 1.56 |
| 5.75 | 25.97 | 0.17 | 1.43 |
| 6 | 28.27 | 0.16 | 1.31 |

As shown in the data above, for each of the different valve seat flow diameters and a plunger bore inner diameter of about 4.50 inches, the resulting ratio is less than 12.0, and more particularly, the resulting ratio is in the range from 11.82 (at a valve seat flow diameter of 2.0 inches) to 1.31 (at a valve seat flow diameter of 6.0 inches).

Example 10—Plunger Bore Inner Diameter=4.75 Inches

In this example, the plunger bore inner diameter is about 4.75 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.51 | 12.47 |
| 2.25 | 3.98 | 1.19 | 9.86 |
| 2.5 | 4.91 | 0.97 | 7.98 |
| 2.75 | 5.94 | 0.80 | 6.60 |
| 3 | 7.07 | 0.67 | 5.54 |
| 3.25 | 8.30 | 0.57 | 4.72 |
| 3.5 | 9.62 | 0.49 | 4.07 |
| 3.75 | 11.04 | 0.43 | 3.55 |
| 4 | 12.57 | 0.38 | 3.12 |
| 4.25 | 14.19 | 0.33 | 2.76 |
| 4.5 | 15.90 | 0.30 | 2.46 |
| 4.75 | 17.72 | 0.27 | 2.21 |
| 5 | 19.63 | 0.24 | 2.00 |
| 5.25 | 21.65 | 0.22 | 1.81 |
| 5.5 | 23.76 | 0.20 | 1.65 |
| 5.75 | 25.97 | 0.18 | 1.51 |
| 6 | 28.27 | 0.17 | 1.39 |

As shown in the data above, for each of the different valve seat flow diameters and a plunger bore inner diameter of about 4.75 inches, the resulting ratio is less than 12.5, and more particularly, the resulting ratio is in the range from 12.47 (at a valve seat flow diameter of 2.0 inches) to 1.39 (at a valve seat flow diameter of 6.0 inches).

Example 11—Plunger Bore Inner Diameter=5.0 Inches

In this example, the plunger bore inner diameter is about 5.0 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 1.59 | 13.13 |
| 2.25 | 3.98 | 1.26 | 10.37 |
| 2.5 | 4.91 | 1.02 | 8.40 |
| 2.75 | 5.94 | 0.84 | 6.94 |
| 3 | 7.07 | 0.71 | 5.84 |
| 3.25 | 8.30 | 0.60 | 4.97 |
| 3.5 | 9.62 | 0.52 | 4.29 |
| 3.75 | 11.04 | 0.45 | 3.73 |
| 4 | 12.57 | 0.40 | 3.28 |
| 4.25 | 14.19 | 0.35 | 2.91 |
| 4.5 | 15.90 | 0.31 | 2.59 |
| 4.75 | 17.72 | 0.28 | 2.33 |
| 5 | 19.63 | 0.25 | 2.10 |
| 5.25 | 21.65 | 0.23 | 1.91 |
| 5.5 | 23.76 | 0.21 | 1.74 |
| 5.75 | 25.97 | 0.19 | 1.59 |
| 6 | 28.27 | 0.18 | 1.46 |

As shown in the data above, for each of the different valve seat flow diameters and a plunger bore inner diameter of about 5.0 inches, the resulting ratio is less than 13.5, and more particularly, the resulting ratio is in the range from 13.13 (at a valve seat flow diameter of 2.0 inches) to 1.46 (at a valve seat flow diameter of 6.0 inches).

Example 12—Plunger Bore Inner Diameter=8.0 Inches

In this example, the plunger bore inner diameter is about 8.0 inches.

| Flow Diameter of Valve Seat (in.) | Flow Area of Valve Seat ($in^2$) | Ratio A = (Plunger Bore Diameter)/(Flow Area) | Ratio B = (Ratio A) * (Tie Rod Spacing) |
|---|---|---|---|
| 2 | 3.14 | 2.55 | 21.01 |
| 2.25 | 3.98 | 2.01 | 16.60 |
| 2.5 | 4.91 | 1.63 | 13.45 |
| 2.75 | 5.94 | 1.35 | 11.11 |
| 3 | 7.07 | 1.13 | 9.34 |
| 3.25 | 8.30 | 0.96 | 7.96 |
| 3.5 | 9.62 | 0.83 | 6.86 |
| 3.75 | 11.04 | 0.72 | 5.98 |
| 4 | 12.57 | 0.64 | 5.25 |
| 4.25 | 14.19 | 0.56 | 4.65 |
| 4.5 | 15.90 | 0.50 | 4.15 |
| 4.75 | 17.72 | 0.45 | 3.72 |
| 5 | 19.63 | 0.41 | 3.36 |
| 5.25 | 21.65 | 0.37 | 3.05 |
| 5.5 | 23.76 | 0.34 | 2.78 |
| 5.75 | 25.97 | 0.31 | 2.54 |
| 6 | 28.27 | 0.28 | 2.33 |

As shown in the data above, for each of the different valve seat flow diameters and a plunger bore inner diameter of about 8.0 inches, the resulting ratio is less than 22, and more particularly, the resulting ratio is in the range from 21.01 (at a valve seat flow diameter of 2.0 inches) to 2.33 (at a valve seat flow diameter of 6.0 inches).

In view of the ranges of valve seat inner diameter being the same in the Examples 7-12 above, the variable in the examples is the plunger bore inner diameter. For the examples with a tie rod spacing of 8.25, the calculated ratio, known as Ratio B, is in the range from 0.58 (for a plunger bore diameter of 2.0 inches and a valve seat inner diameter of 6.0 inches) to 21.01 (for a plunger bore diameter of 8.0 inches and a valve seat inner diameter of 2.0 inches). The embodiments set forth in the above examples are sized to permit a fluid end casing having those dimensions to mounted on and coupled to standard tie rods that have longitudinal axes that are spaced 8.25 inches apart.

By varying the relationship between the diameters as described above, a variety of different sized fluid ends can be used with standard tie rods, provided that the calculated ratio B is less than 22, and more particularly is in the range from 0.44 to 21.01.

Figure 16:
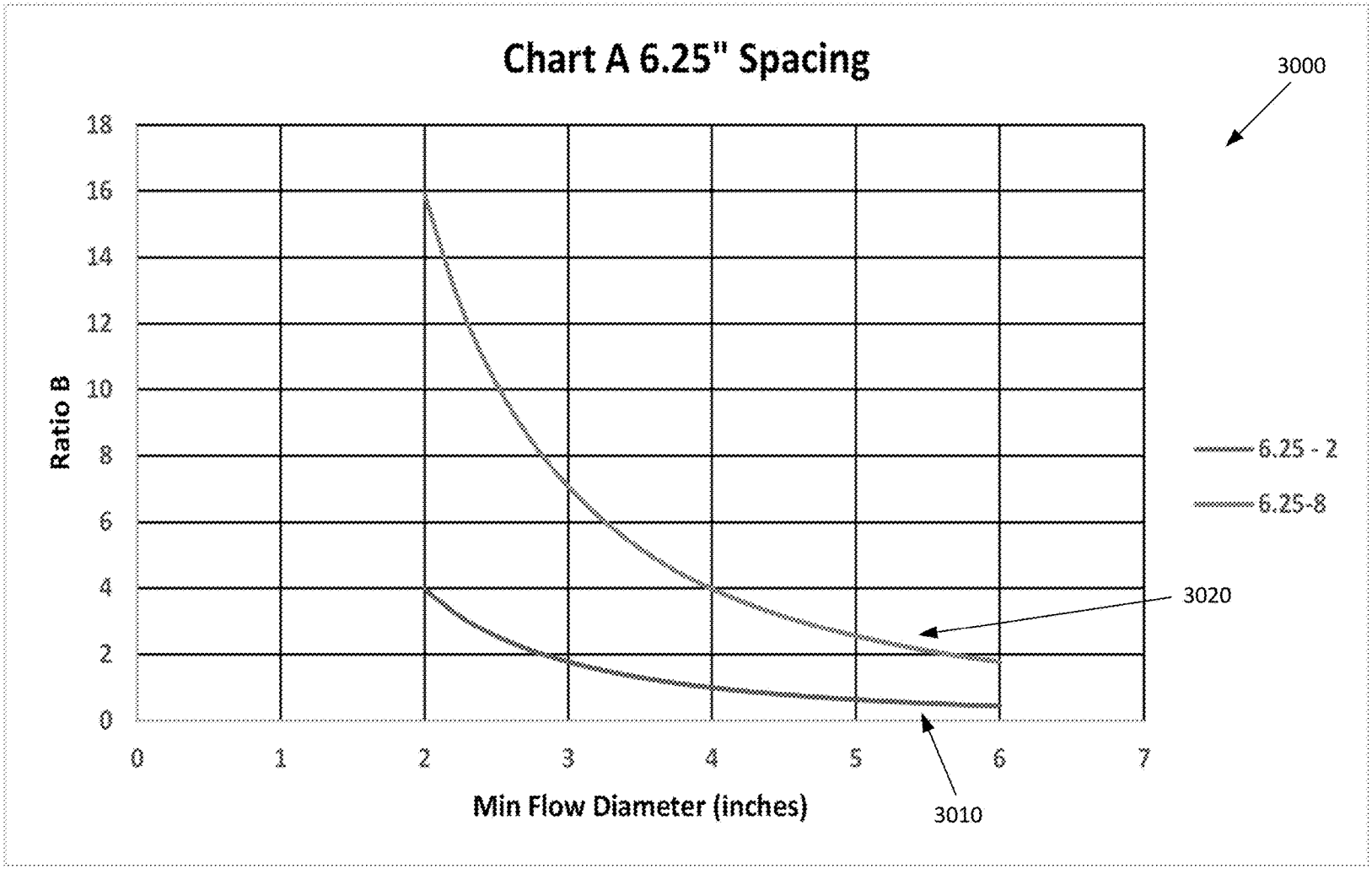
FIG. 16 is a graph illustrating the relationship between a minimum flow diameter and Ratio B for a tie rod spacing of 6.25 inches.
Figure 17:
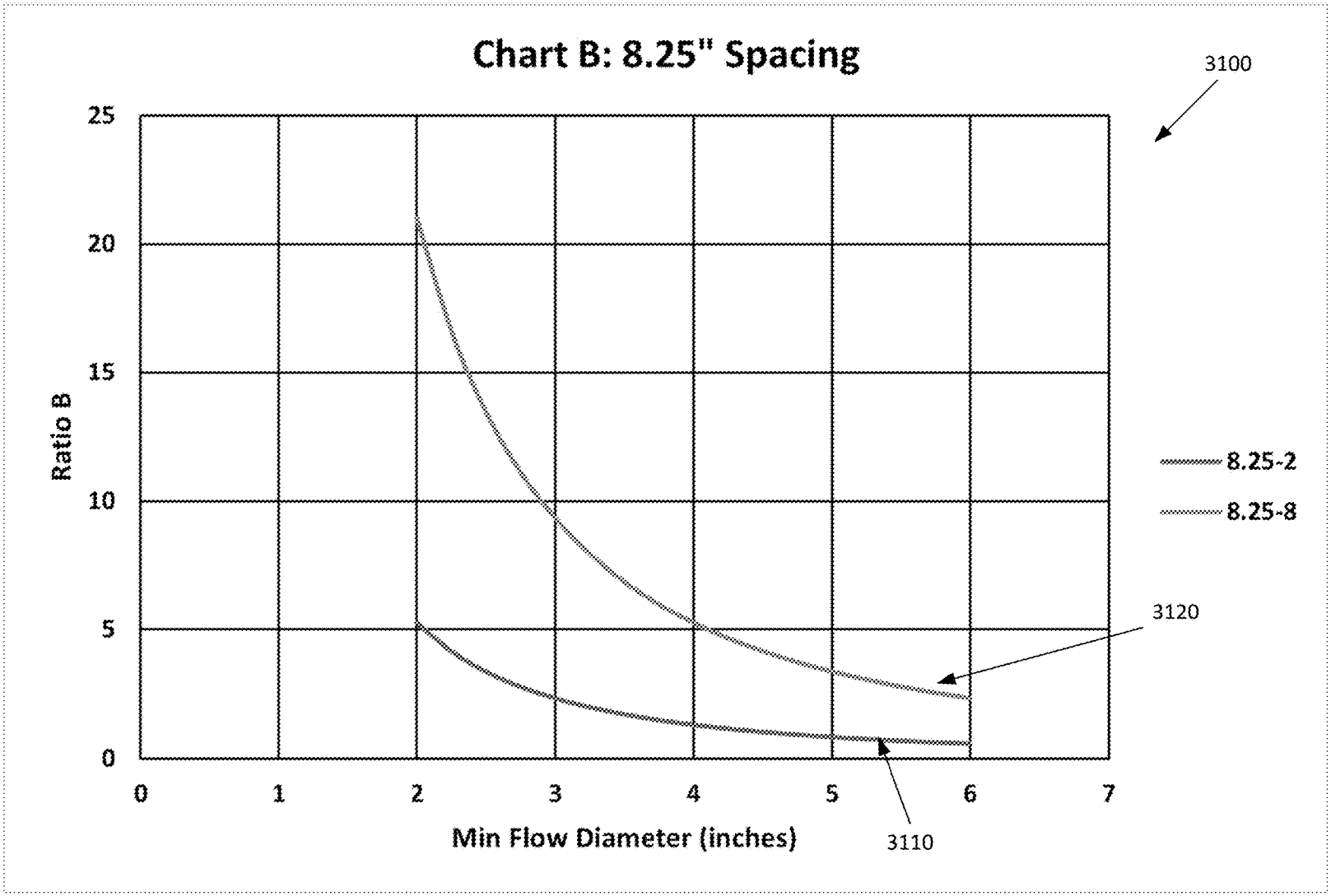
FIG. 17 is a graph illustrating the relationship between a minimum flow diameter and Ratio B for a tie rod spacing of 6.25 inches.
Figure 18:
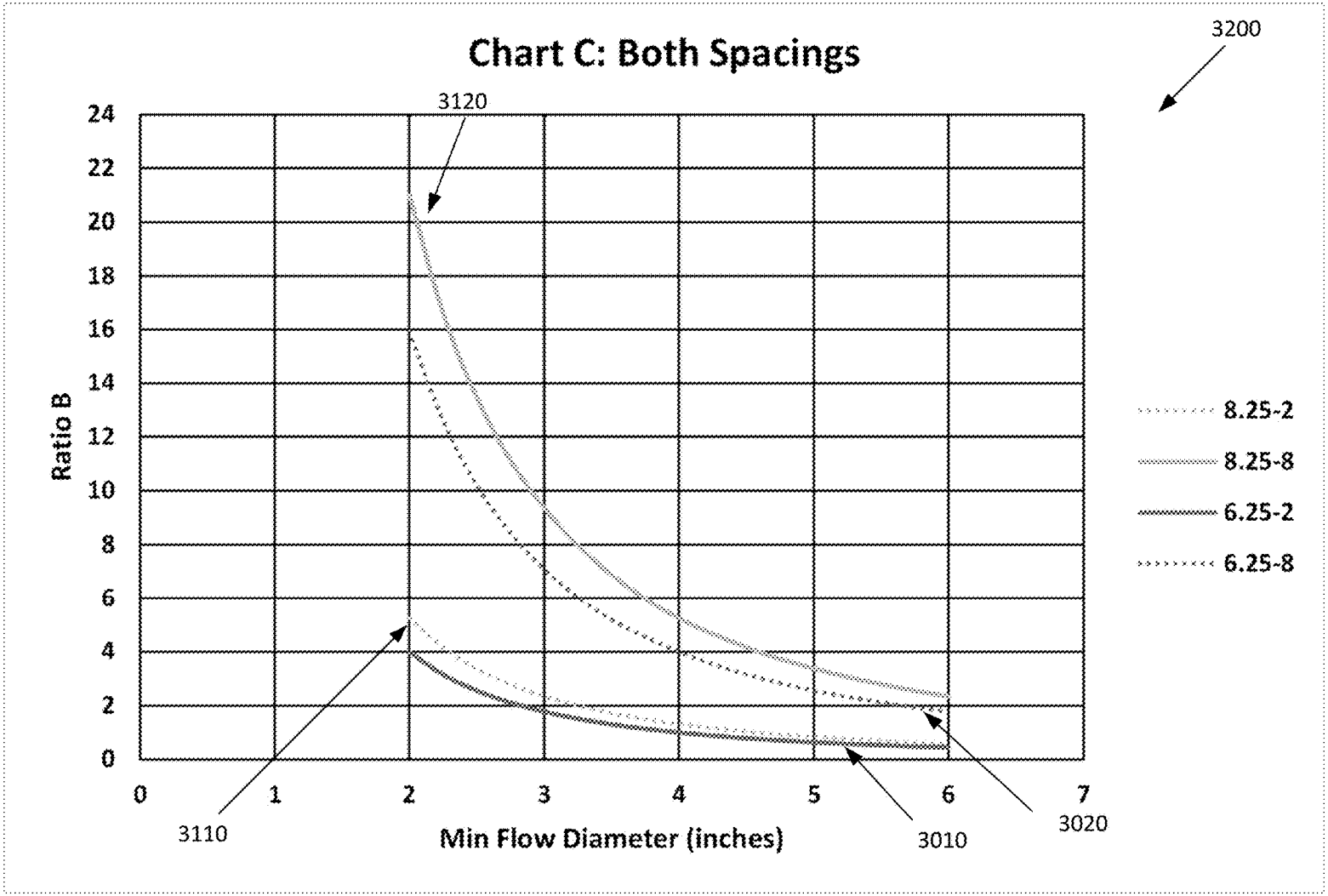
FIG. 18 is a graph illustrating the relationships shown in FIG. 16 and FIG. 17.

Referring to FIGS. 16-18, graphs of data from the Examples described above are illustrated. Turning initially to FIG. 16, graph 3000 or chart A shows the relationship between a minimum flow diameter (in inches) and Ratio B, which is dimensionless, for a tie rod spacing of 6.25 inches. The lower graphed line 3010 in graph 3000 corresponds to data from Example 1 above, which is based on a plunger bore inner diameter of 2.0 inches for a tie rod spacing of 6.25 inches. As the minimum flow diameter of a valve seat is changed over the range from about 2.0 inches to about 6.0 inches, the resulting Ratio B changes over the corresponding range from 3.98 to 0.44 as described above. The upper graphed line 3020 in graph 3000 corresponds to data from Example 6 above, which is based on a plunger bore inner diameter of about 8.0 inches for a tie rod spacing of 6.25 inches. As the minimum flow diameter of a valve seat is changed over the range from about 2.0 inches to about 6.0 inches, the resulting Ratio B changes over the corresponding range from 15.92 to 1.77 as described above.

Thus, the data from Examples 1 through 6, as well as the range of permitted designs of the fluid end for a tie rod spacing of 6.25 inches over the range of minimum flow diameters from about 2.0 inches to about 6.0 inches are located between the two graphed lines 3010 and 3020 in graph 3000. In other words, for minimum flow diameters over the range from 2.0 inches to 6.0 inches, the dimension relationships that would permit a tie rod spacing of 6.25 inches to be used are above the lower graphed line 3010 and below the upper graphed line 3020. The data from Examples 2 through 5 above would be in between the lower line 3010 and the upper line 3020.

Similarly, referring to FIG. 17, graph 3100 or chart B shows the relationship between a minimum flow diameter (in inches) and Ratio B, which is dimensionless, for a tie rod spacing of 8.25 inches. The lower graphed line 3110 in graph 3100 corresponds to data from Example 7 above, which is based on a plunger bore inner diameter of 2.0 inches for a tie rod spacing of 8.25 inches. As the minimum flow diameter of a valve seat is changed over the range from about 2.0 inches to about 6.0 inches, the resulting Ratio B changes over the corresponding range from 5.25 to 058 as described above. The upper graphed line 3120 in graph 3100 corresponds to data from Example 12 above, which is based on a plunger bore inner diameter of about 8.0 inches for a tie rod spacing of 8.25 inches. As the minimum flow diameter of a valve seat is changed over the range from about 2.0 inches to about 6.0 inches, the resulting Ratio B changes over the corresponding range from 21.01 to 2.33 as described above.

Thus, the data from Examples 7 through 12, as well as the range of permitted designs of the fluid end for a tie rod spacing of 8.25 inches over the range of minimum flow diameters from about 2.0 inches to about 6.0 inches are located between the two graphed lines 3110 and 3120 in graph 3100. In other words, for minimum flow diameters over the range from 2.0 inches to 6.0 inches, the dimension relationships that would permit a tie rod spacing of 8.25 inches to be used are above the lower graphed line 3110 and below the upper graphed line 3120. The data from Examples 8 through 11 above would be in between the lower line 3110 and the upper line 3120.

Turning to FIG. 18, a graph 3200 or chart C is illustrated that includes the graphed lines 3010 and 3020 from graph 3000 in FIG. 16 and the graphed lines 3110 and 3120 from graph 3100 in FIG. 17. The result is a combined merging of the lines relating to a tie rod spacing of about 6.25 inches and a tie rod spacing of about 8.25 inches. The range of acceptable dimensions for a fluid end casing is shown in graph 3200 between the lowest line 3010, which represents a 2 inch plunger bore diameter and a 6.25 inch tie rod spacing, and the highest line 3120, which represents an 8 inch plunger bore diameter and an 8.25 inch tie rod spacing. Thus, the data from Examples 1 through 12, including the range of designs therebetween, are located between graphed lines 3010 and 3120 in graph 3200, which represent the range of acceptable fluid end dimension relationships.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A reciprocating pump, comprising:

a power end configured to generate pumping power;

a fluid end having a fluid end casing including:

an inlet bore having a valve seat located therein, the valve seat having a first inner surface and a flow area defined by a plane extending across the valve seat;

a plunger bore having a second inner surface defining a plunger bore inner diameter;

a first hole extending through the fluid end casing from a first outer surface of the fluid end casing to a second outer surface of the fluid end casing opposite the first outer surface, the first hole having a first longitudinal axis; and a second hole extending through the fluid end casing from the first outer surface to the second outer surface, the second hole having a second longitudinal axis, the second hole extending parallel to the first hole, the second longitudinal axis is spaced apart from the first longitudinal axis by a first distance; and a plurality of couplers mounting the fluid end to the power end, the plurality of couplers including a first coupler extending through the first hole and a second coupler extending through the second hole, each of the first coupler and the second coupler is connected at one end to the power end and has a fastener secured to its other end to retain the fluid end casing, wherein the plunger bore inner diameter divided by the flow area is a first ratio, the first ratio multiplied by the first distance is a second ratio, and the second ratio is less than 22.

2. The reciprocating pump of claim 1, wherein the first inner surface defines a valve seat inner diameter, and the valve seat inner diameter is in a range from 2 inches to 6 inches.

3. The reciprocating pump of claim 2, wherein the first distance is substantially 6.25 inches.

4. The reciprocating pump of claim 3, wherein the plunger bore inner diameter is in a range from 2 inches to 8 inches, and the second ratio is less than 16.

5. The reciprocating pump of claim 3, wherein the plunger bore inner diameter is in a range from 2 inches to 8 inches, and the second ratio is in a range from 0.44 to 15.92.

6. The reciprocating pump of claim 3, wherein the plunger bore inner diameter is in a range from 4 inches to 5 inches, and the second ratio is in a range from 0.88 to 9.95.

7. The reciprocating pump of claim 2, wherein the first distance is substantially 8.25 inches.

8. The reciprocating pump of claim 7, wherein the plunger bore inner diameter is in a range from 2 inches to 8 inches, and the second ratio is less than 22.

9. The reciprocating pump of claim 7, wherein the plunger bore inner diameter is in a range from 2 inches to 8 inches, and the second ratio is in a range from 0.58 to 21.01.

10. The reciprocating pump of claim 7, wherein the plunger bore inner diameter is in a range from 4 inches to 5 inches, and the second ratio is in a range from 1.17 to 13.13.

11. A reciprocating pump, comprising:

a power end configured to generate pumping power;

a fluid end having a fluid end casing including:

an inlet bore having a valve seat located therein, the valve seat defining a valve seat inner diameter, the valve seat inner diameter is in a range from 2 inches to 6 inches, and the valve seat defines a cross-sectional flow area extending across the valve seat;

a plunger bore defining a plunger bore inner diameter, the plunger bore inner diameter is in a range from 2 inches to 8 inches;

a first hole extending through the fluid end casing from a first outer surface of the fluid end casing to a second outer surface of the fluid end casing opposite the first outer surface, and the first hole having a first longitudinal axis; and a second hole extending through the fluid end casing from the first outer surface to the second outer surface, and the second hole having a second longitudinal axis, the second longitudinal axis is parallel to and spaced apart from the first longitudinal axis by a first distance, the first distance is substantially 6.25 inches;

a first tie rod extending through the first hole, the first tie rod is connected to the power end and to the fluid end; and a second tie rod extending through the second hole, the second tie rod is connected to the power end and to the fluid end, wherein the plunger bore inner diameter divided by the cross-sectional flow area is a first ratio, the first ratio multiplied by the first distance is a second ratio, and the second ratio is less than 16.

12. The reciprocating pump of claim 11, wherein the second ratio is in a range from 0.44 to 15.92.

13. The reciprocating pump of claim 11, wherein the plunger bore inner diameter is in a range from 4 inches to 5 inches, and the second ratio is in a range from 0.88 to 9.95.

14. The reciprocating pump of claim 11, wherein the plunger bore inner diameter is in a range from 2 inches to 4 inches, and the second ratio is in a range from 0.44 to 7.96.

15. The reciprocating pump of claim 11, wherein the plunger bore inner diameter is in a range from 5 inches to 8 inches, and the second ratio is in a range from 1.11 to 15.92.

16. A reciprocating pump, comprising:

a power end configured to generate pumping power;

a fluid end having a fluid end casing including:

an inlet bore having a valve seat located therein, the valve seat defining a valve seat inner diameter, the valve seat inner diameter is in a range from 2 inches to 6 inches, and the valve seat defines a cross-sectional flow area extending across the valve seat;

a plunger bore defining a plunger bore inner diameter, the plunger bore inner diameter is in a range from 2 inches to 8 inches;

a first hole extending through the fluid end casing from a first outer surface of the fluid end casing to a second outer surface of the fluid end casing opposite the first outer surface, and the first hole having a first longitudinal axis; and a second hole extending through the fluid end casing from the first outer surface to the second outer surface, and the second hole having a second longitudinal axis, the second longitudinal axis is parallel to and spaced apart from the first longitudinal axis by a first distance, the first distance is substantially 8.25 inches;

a first tie rod extending through the first hole, the first tie rod is connected to the power end and to the fluid end; and a second tie rod extending through the second hole, the second tie rod is connected to the power end and to the fluid end, wherein the plunger bore inner diameter divided by the cross-sectional flow area is a first ratio, the first ratio multiplied by the first distance is a second ratio, and the second ratio is less than 22.

17. The reciprocating pump of claim 16, wherein the second ratio is in a range from 0.58 to 21.01.

18. The reciprocating pump of claim 16, wherein the plunger bore inner diameter is in a range from 4 inches to 5 inches, and the second ratio is in a range from 1.17 to 13.13.

19. The reciprocating pump of claim 16, wherein the plunger bore inner diameter is in a range from 2 inches to 4 inches, and the second ratio is in a range from 0.58 to 10.50.

20. The reciprocating pump of claim 16, wherein the plunger bore inner diameter is in a range from 5 inches to 8 inches, and the second ratio is in a range from 1.46 to 21.01.

* * * * *